US006367603B1

(12) United States Patent
Tiramani et al.

(10) Patent No.: US 6,367,603 B1
(45) Date of Patent: Apr. 9, 2002

(54) CONTAINMENT ARTICLE HAVING A PAIR OF HINGEDLY CONNECTED, SUBSTANTIALLY IDENTICAL PLASTIC SHELLS AND RELATED IMPROVEMENTS

(75) Inventors: Paolo M. B. Tiramani; John A. Bozak, both of Greenwich; Soohyun Ham, Stamford, all of CT (US)

(73) Assignee: 500 Group, Inc., Greenwich, CT (US)

( * ) Notice: Subject to any disclaimer, the term of this patent is extended or adjusted under 35 U.S.C. 154(b) by 0 days.

(21) Appl. No.: 09/497,714

(22) Filed: Feb. 4, 2000

(51) Int. Cl.[7] ..... A45C 3/00; A45C 3/02

(52) U.S. Cl. ..... 190/100; 190/18 A; 190/39; 190/119; 190/115; 190/120

(58) Field of Search ..... 190/18 A, 39, 190/100, 119, 120, 115

(56) References Cited

U.S. PATENT DOCUMENTS

| | | | | | |
|---|---|---|---|---|---|
| 1,198,524 | A | * | 9/1916 | Cunliffe | 220/844 |
| 1,666,652 | A | * | 4/1928 | Hiering | 220/844 |
| 1,686,736 | A | * | 10/1928 | Davison | 220/844 |
| 2,762,076 | A | * | 9/1956 | Kiba | 220/844 |
| 3,010,552 | A | * | 11/1961 | Davidson | 220/4.24 |
| 3,236,404 | A | * | 2/1966 | Boscamp | 220/4.24 |
| 3,275,336 | A | * | 9/1966 | Warner, Jr. | 190/115 |
| 3,451,580 | A | * | 6/1969 | Husby | 220/4.24 |
| 3,497,041 | A | * | 2/1970 | Samhammer | 190/119 |
| 4,294,299 | A | * | 10/1981 | Dorsen et al. | 220/4.24 |
| 4,366,686 | A | * | 1/1983 | Remington et al. | 70/71 |
| 4,452,373 | A | * | 6/1984 | Pearce et al. | 220/335 |
| 4,509,622 | A | * | 4/1985 | Morszeck | 190/115 |
| 4,561,705 | A | * | 12/1985 | Schafer | 220/4.24 |
| 4,588,114 | A | * | 5/1986 | Lebaron et al. | 224/42.44 X |
| 4,615,464 | A | * | 10/1986 | Byrns | 220/4.23 |
| 5,211,302 | A | * | 5/1993 | Tiramani | 220/4.24 |
| 5,644,816 | A | * | 7/1997 | Chou | 190/18 A X |
| 5,755,311 | A | | 5/1998 | Younessian et al. | |
| 5,924,533 | A | * | 7/1999 | Cnockaert et al. | 190/115 X |
| 6,032,771 | A | * | 3/2000 | Pedrini | 190/39 X |

FOREIGN PATENT DOCUMENTS

| | | | | |
|---|---|---|---|---|
| CA | 618798 | * | 4/1961 | 190/100 |

* cited by examiner

*Primary Examiner*—Joseph M. Moy
(74) *Attorney, Agent, or Firm*—David V. Radack; Brij K. Agarwal; Eckert Seamans Cherin & Mellott, LLC

(57) ABSTRACT

A containment article, such as a luggage article, is provided which comprises a pair of substantially identical plastic shells which are hingedly connected to each other. The invention also includes an improved telescoping handle assembly for an article, such as wheeled luggage as well as a unique and novel safety latch for a containment article.

28 Claims, 23 Drawing Sheets

CONTAINMENT ARTICLE HAVING A PAIR OF HINGEDLY CONNECTED, SUBSTANTIALLY IDENTICAL PLASTIC SHELLS AND RELATED IMPROVEMENTS

BACKGROUND OF THE INVENTION

This invention relates to a containment article having a pair of hingedly connected, substantially identical shells and related improvements.

Containment articles, and more particularly, luggage articles made of a pair of injection molded plastic shells, are known. However, the shells for the luggage articles are separate non-identical pieces which require separate molds for their manufacture. There are several disadvantages with this method, of manufacturing. One is that both machines must have open capacity or capacity reserved for production cycles within a close time frame of each other. This results in logistical inefficiency. Second, the machines should be located preferably in the same plant and sometimes that is not the case. Third, shells made by different machines and/or different molds have different molding times meaning that one molding machine will always be waiting for another molding machine to finish in order to make the pair of shells necessary for a completed luggage article. Fourth, different shells will distort and shrink at different rates thus requiring greater accuracy in molding and slower cycle times yielding higher manufacturing prices. Finally, different shells cannot nest, thus leading to inefficiencies in storage and shipping.

What is needed, therefore, is a containment article, such as a luggage article, having a pair of plastic shells that can be easily and efficiently manufactured and assembled. What is also needed is an improved telescoping handle assembly as well as an improved safety latch for containment articles, such as luggage articles.

SUMMARY OF THE INVENTION

The invention has met or exceeded the above-mentioned needs as well as others. A containment article, such as a luggage article, is provided which comprises a pair of substantially identical plastic shells which are hingedly connected to each other.

The invention also includes a unique and novel safety latch for a containment article and also an improved telescoping handle assembly for an article, such as wheeled luggage.

BRIEF DESCRIPTION OF THE DRAWINGS

A full understanding of the invention can be gained from the following detailed description of the invention when read in conjunction with the accompanying drawings in which.

DETAILED DESCRIPTION

Figure 1:
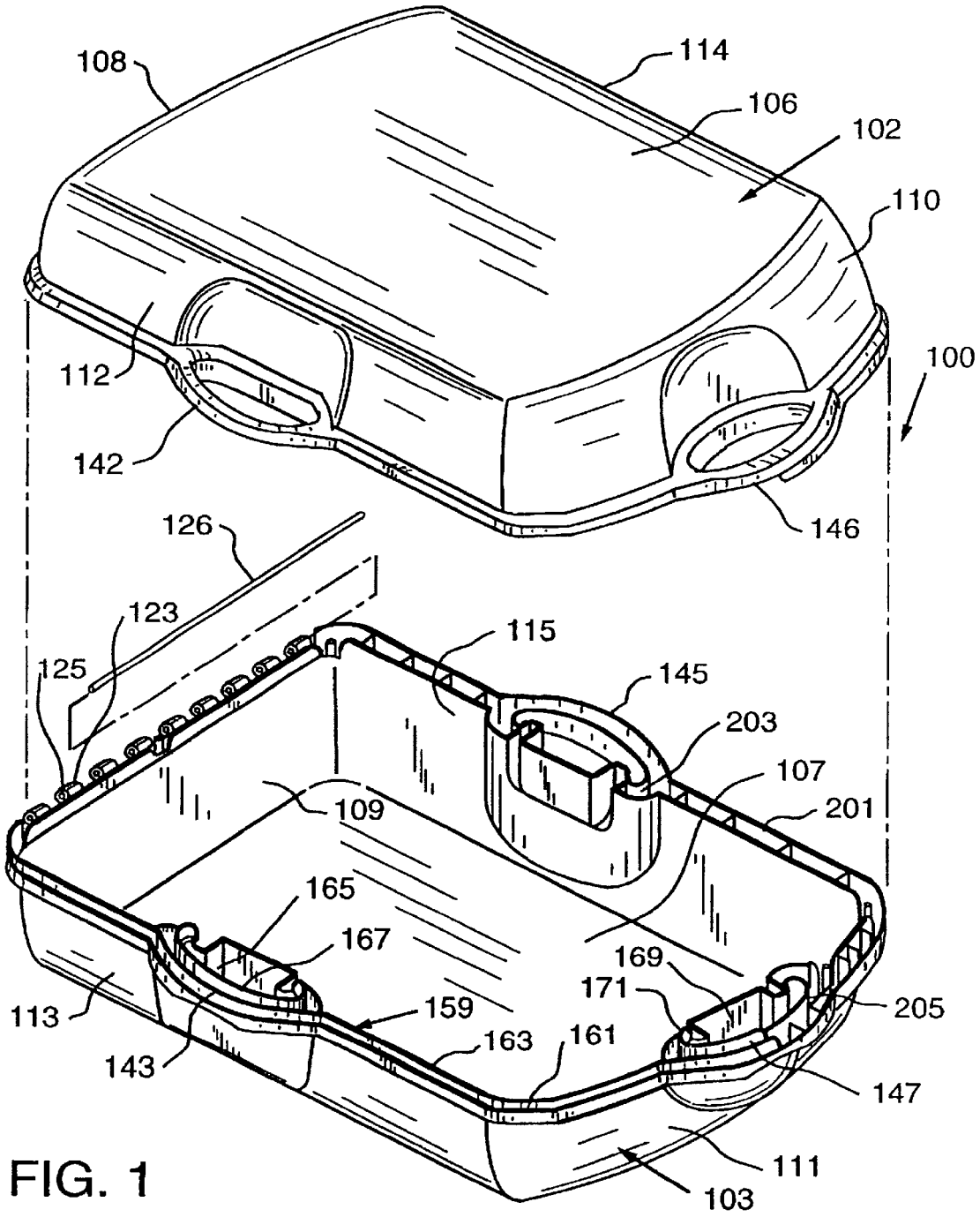
FIG. 1 is an exploded perspective view showing the two shells of the containment article as if looking down on the article.

Referring now more particularly to FIGS. 1–4 and 4*a,* a basic, stripped-down version of a containment article 100 made in accordance with the invention is shown. The containment article 100 can be adapted for many different uses, such as a toolbox, equipment carrier or a luggage article. The containment article 100 consists of two substantially identical shells 102, 103 which are hingedly connected to each other by means of a hinge member 104, which will be described in detail below. Each shell 102, 103 includes a major planar portion 106, 107 along with four sidewalls. The embodiment shown in FIGS. 1–4 includes bottom sidewalls 108, 109; top sidewalls 110, 111 and a pair of side sidewalls 112, 113 and 114, 115, respectively, for each shell 102, 103.

Figure 3:
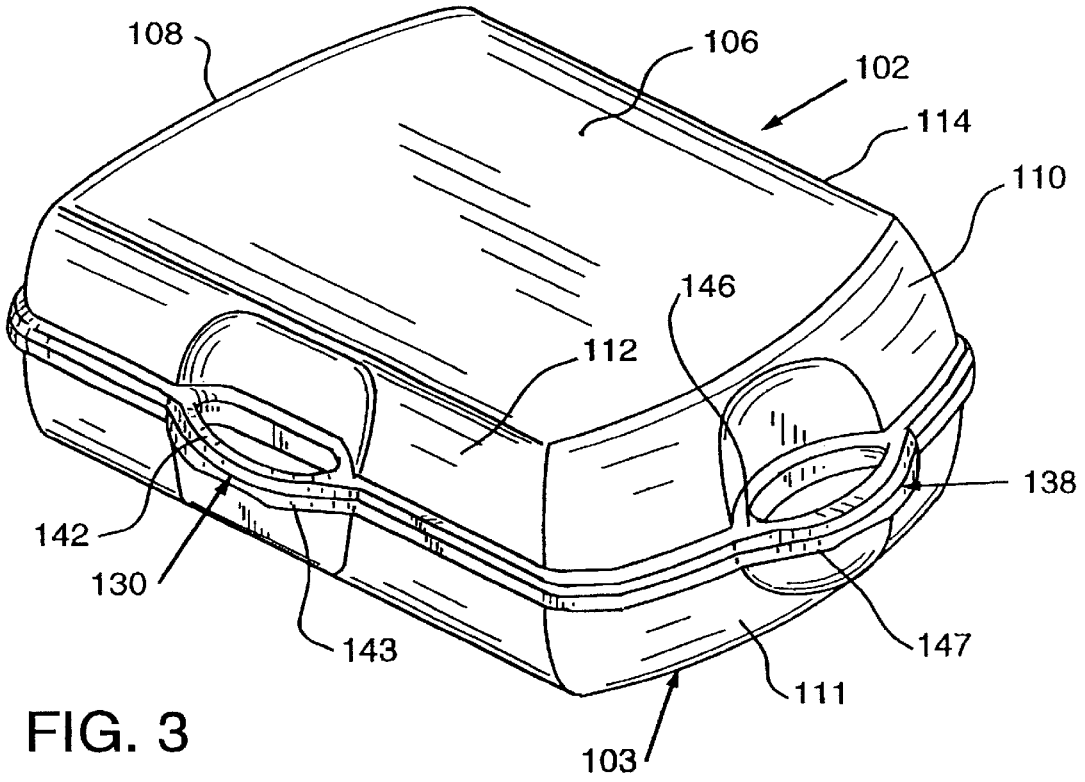
FIG. 3 is a front perspective view of the assembled containment article.
Figure 4:
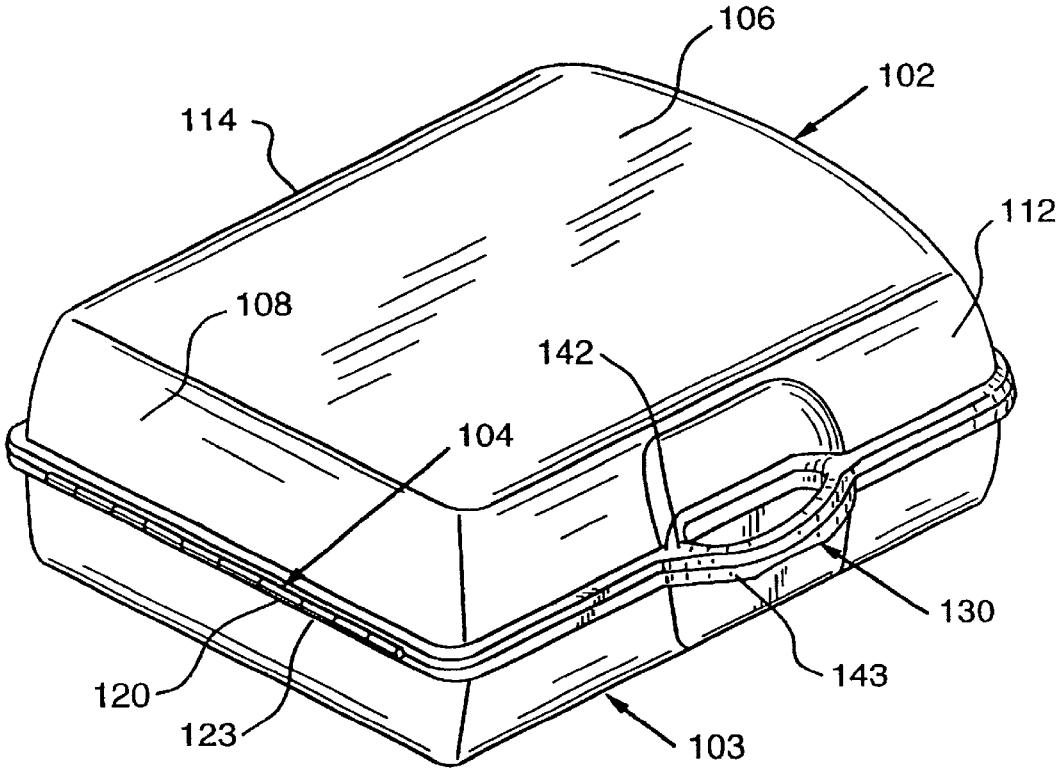
FIG. 4 is a back perspective view of the assembled containment article.
Figure 4A:
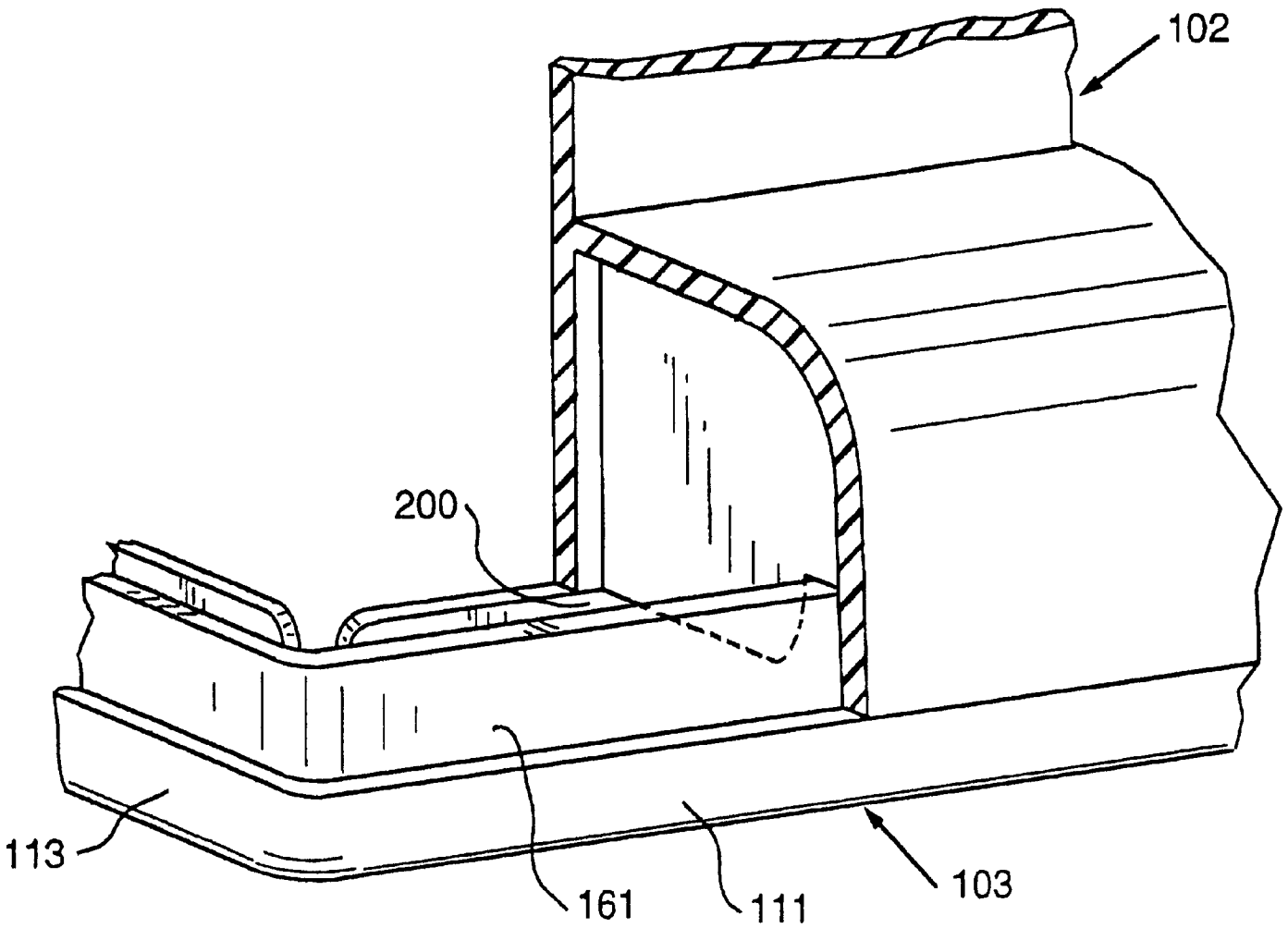
FIG. 4*a* is a cross-sectional view showing how the tongue mates with the groove when the shells are joined to form the closed containment article.

The hinge member 104 consists of a plurality of spaced apart hinge tubes disposed on the edge of each of the bottom sidewalls 108, 109. The hinge tubes, such as hinge tube 120 integrally formed with bottom sidewall 108, includes a hinge pin opening 122. A hinge tube 123 integrally formed with bottom sidewall 109 includes a hinge pin opening 125. It will be appreciated that when the shells 102, 103 are joined together to form the containment article 100, the hinge pin openings, such as hinge pin openings 122 and 125, are generally aligned with each other so that a hinge pin 126 can be inserted therethrough in order to hingedly connect the shells 102, 103 to each other as shown in FIGS. 3 and 4.

FIGS. 1–4 also show the combination carrying handle/bumper members of the invention. The side and top sidewalls, when joined, form a three separate carrying handle/bumper members 130, 134 and 138. As can best be seen in FIGS. 1 and 2, carrying handle/bumper member 130 is formed by providing an integrally formed member 142 extending from side sidewall 112 and an integrally formed member 143 extending from side sidewall 113. Carrying handle/bumper member 134 is formed by providing an integrally formed member 144 (FIG. 2) extending from side sidewall 114 and an integrally formed member 145 (FIG. 1) extending from side sidewall 115. Finally, carrying handle/bumper member 138 is formed by providing an integrally formed member 146 extending from top sidewall 110 and an integrally formed member 147 extending from top sidewall 111. As the two shells 102, 103 are identically shaped, these various integrally formed members, when joined together, form the carrying handle/bumper members 130, 134 and 138. As suggested by their name, the carrying handle/bumper members 130, 134 and 138 serve two main purposes. The first purpose is to provide a plurality of different carrying handles for the containment article 100. The second purpose is to provide a bumper member for protecting latch hardware (not shown in FIGS. 1–4) which is used to maintain the containment article 100 in a closed position. The latch aspect of the invention will be discussed below with respect to the luggage article shown in FIG. 5.

Figure 2:
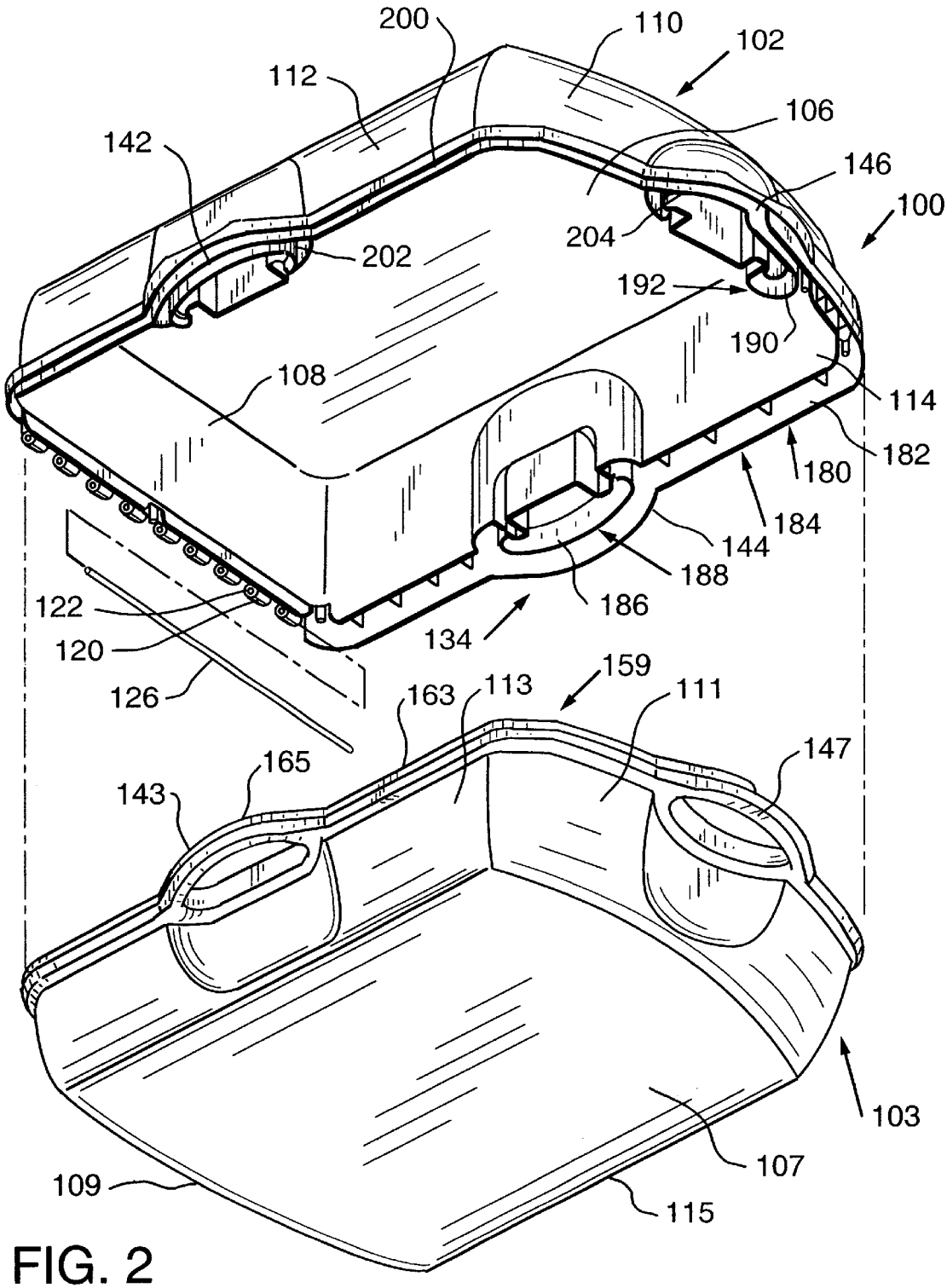
FIG. 2 is an exploded perspective view showing the two shells of the containment article as if looking up at the article.

Another aspect of the invention is shown in FIGS. 1–4 and FIG. 4*a*. In order to provide torsional stability to the containment article 100 when it is closed, the shells 102, 103 are preferably provided with complementary tongue and groove portions. Referring to FIG. 1, shell 103 has a perimeter 159 which includes a tongue 161 that is disposed along the entire perimeter 163 of the side sidewall 113 and along one-half of the perimeter of top sidewall 111. It can also be seen that a tongue 165 is also integrally formed on the perimeter 167 of integrally formed member 143. Another tongue 169 is integrally formed along one-half of the perimeter 171 of integrally formed member 147. Referring now to FIG. 2, shell 102 has a perimeter 180 which includes a tongue 182 that is disposed along the entire perimeter 184 of the side sidewall 114 and along one-half of the perimeter of top sidewall 110. It can also be seen that a tongue 186 is also integrally formed on the perimeter 188 of integrally formed member 144. Another tongue 190 is integrally formed along one-half of the perimeter 192 of integrally formed member 146.

Complementary grooves are provided in the perimeter of each of the shells 102, 103 to receive the tongues described above. Referring to FIG. 2, shell 102 includes a groove 200 extending along the entire perimeter of side sidewall 112 and one-half of the perimeter of top sidewall 110. A groove 202 is also provided in integrally formed member 142. A groove 204 is also provided in one-half of integrally formed member 146. Shell 103 includes a groove 201 extending along the entire perimeter of the side sidewall 115 and one-half of the top sidewall 111. A groove 203 is also provided in integrally formed member 145 and a groove 205 is also provided in one-half of integrally formed member 147.

As it will be appreciated, shells 102, 103 are substantially identical so that when one shell (say shell 102) is flipped over to mate with shell 103, the tongues go into the grooves and the hinge tubes interlock to form the containment article 100 of the invention. This can best be seen by observing FIG. 4*a* which shows tongue 161 engaging into groove 200. Because the two shells 102, 103 are substantially identical in form and shape, there are enormous advantages over prior art containment articles that have different shells that are then joined to form the containment article. The shells 102, 103 are preferably made by an injection molding process and are made of a plastic material, such as (but not limited to) polypropylene, polyethylene, polystyrene, acrylonitrile-butadiene-styrene resin (ABS), polycarbonate, polyvinyl chloride (PVC) or combinations thereof. Because the shells 102, 103 are identical, only one mold needs to be used to produce the containment article 100. Thus, tooling and mold charges to manufacture the total container are halved. Also, by using the same mold, the mold needs to run only two cycles to produce two shells, which equate to one container. In this way, the mold machine can be utilized 100% of the time on the manufacture of a single component. This volume can be achieved 50% earlier than traditional containment article design which might use two machines 50% of the time each. This has the effect of lowering manufacturing costs.

Another benefit is that when molding each shell in different machines (which would be the case if the shells were not identical) hidden costs are incurred due to logistical inefficiencies. That is, both machines must have open capacity or capacity reserved for production cycles within a close time frame with each other. Should problems arise, production inefficiencies are created. Also, the machines running the two separate shells need to be located near each other. In accordance with the invention, only one mold and one machine are needed. Furthermore, the molding times of separate non-identical shells will also be different, thus meaning that one molding machine may have to wait for another molding machine to finish in order to produce the two shells needed for a containment article. Still further, different shells will distort and shrink at slightly different rates. This requires greater accuracy in molding and slower cycle times therefore yielding higher manufacturing costs. The invention herein eliminates this problem because both shells 102, 103 are substantially identical. Finally, because the shells 102, 103 are identical, they can be nested in an efficient and space saving manner.

Thus, it will be appreciated that the method of the invention involves providing a single mold and making a first shell and then making a second shell using the same mold. The method then provides that the first shell and the second shell are hingedly connected to make a containment article.

Referring now to FIGS. 5–13, a luggage article 300 made in accordance with the invention is shown. The luggage article 300 consists of basically the same two shells 302, 303 with the tongue and groove feature discussed above and including hinge member 304 as was also discussed above, only with some slight modifications to accommodate the various hardware (i.e., latches, carrying handles, feet and wheels) that are traditionally found on luggage articles. The shells 302, 303 are formed with openings to receive a pair of wheels 310, 312 on shell 302 and a pair of resting feet 313, 315 on shell 303. It will be appreciated that instead of wheels 310, 312, castors can be provided. Also, it will be appreciated that where four wheels or castors are desired, the resting feet 313, 315 can be replaced with an extra set of wheels or castors. The wheels (or castors) will permit the luggage article to be moved along a floor surface, as is well known.

Figure 5:
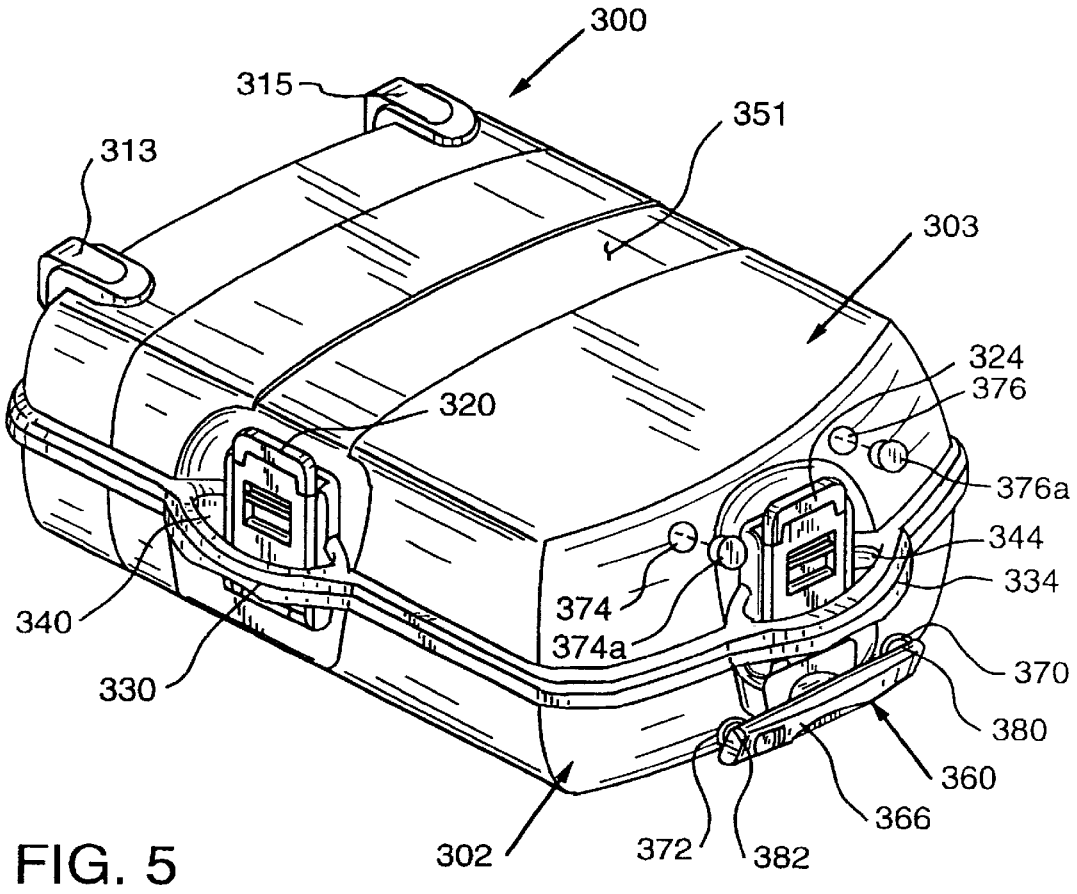
FIG. 5 is a front perspective view of a luggage article embodiment of the invention.
Figure 6:
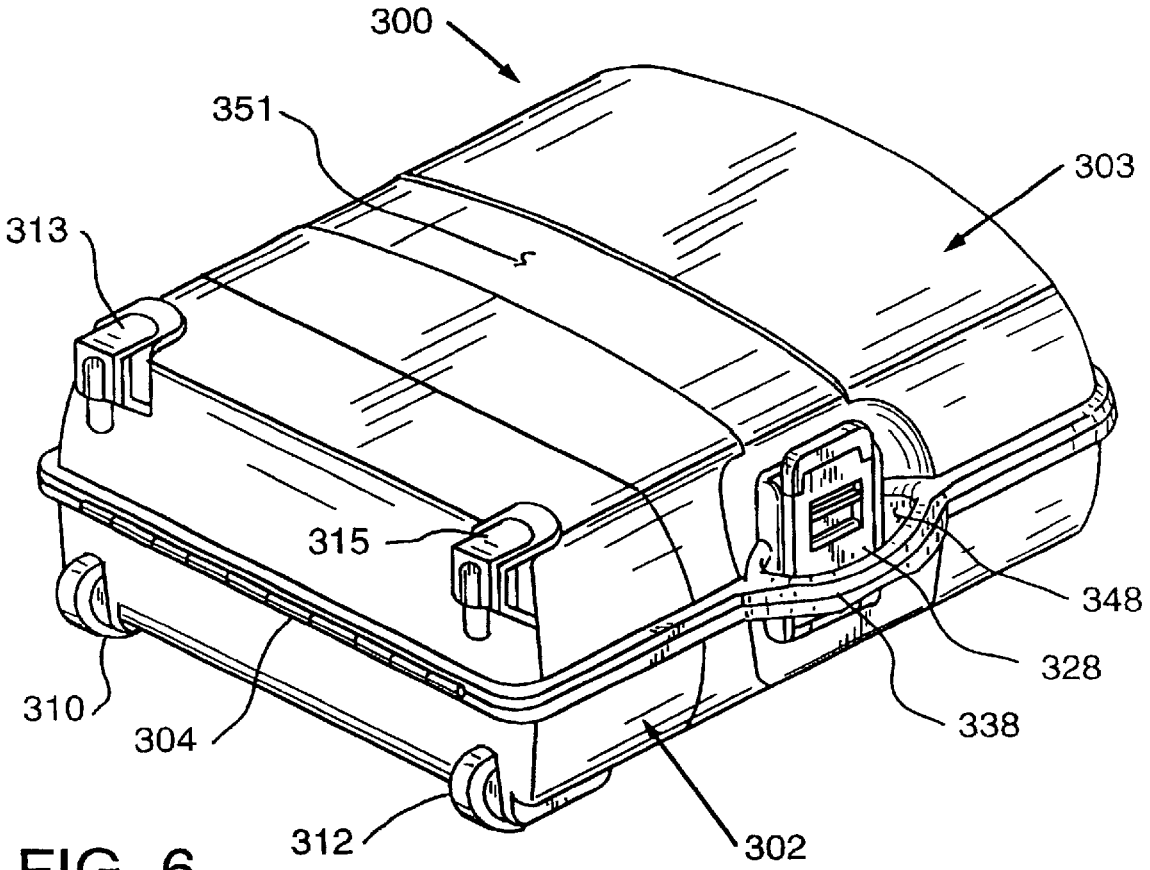
FIG. 6 is a back perspective view of the luggage article of FIG. 5.
Figure 7:
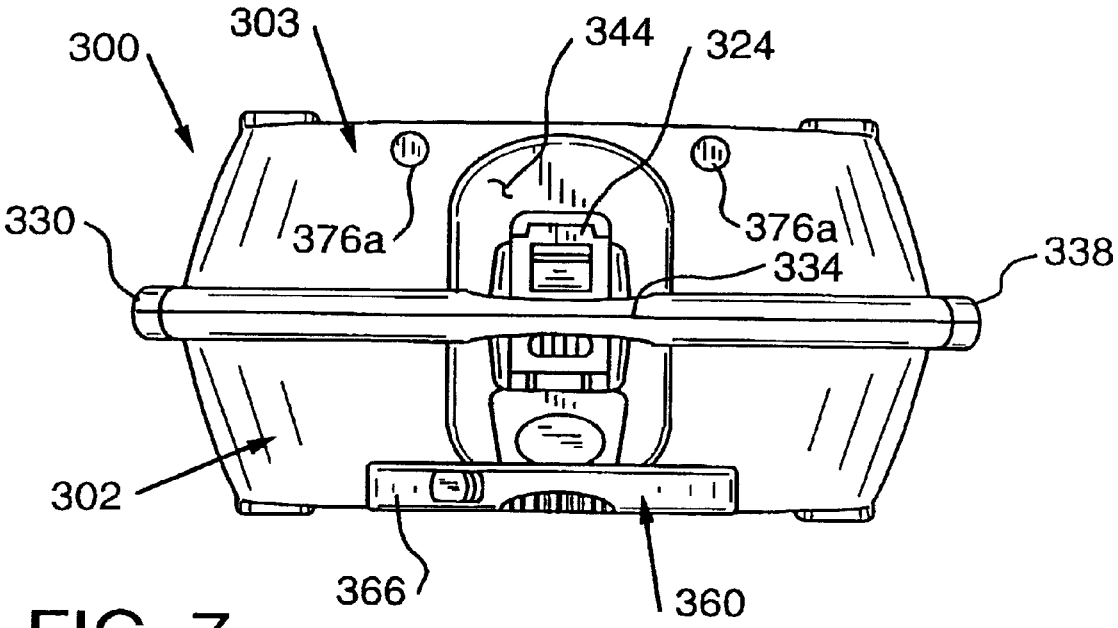
FIG. 7 is a top plan view of the luggage article of FIG. 5.
Figure 8:
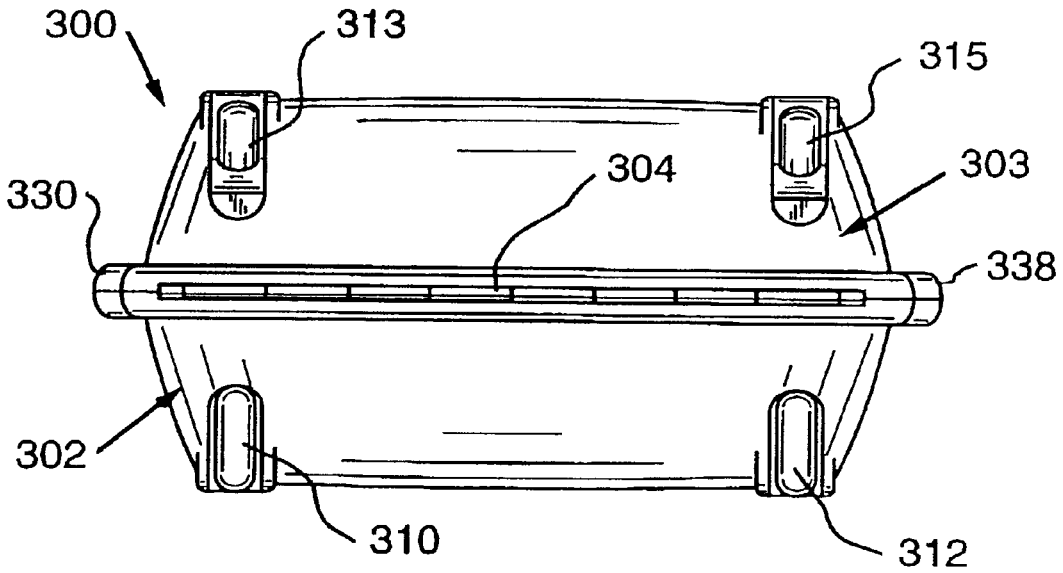
FIG. 8 is a bottom plan view of the luggage article of FIG. 5.
Figure 10:
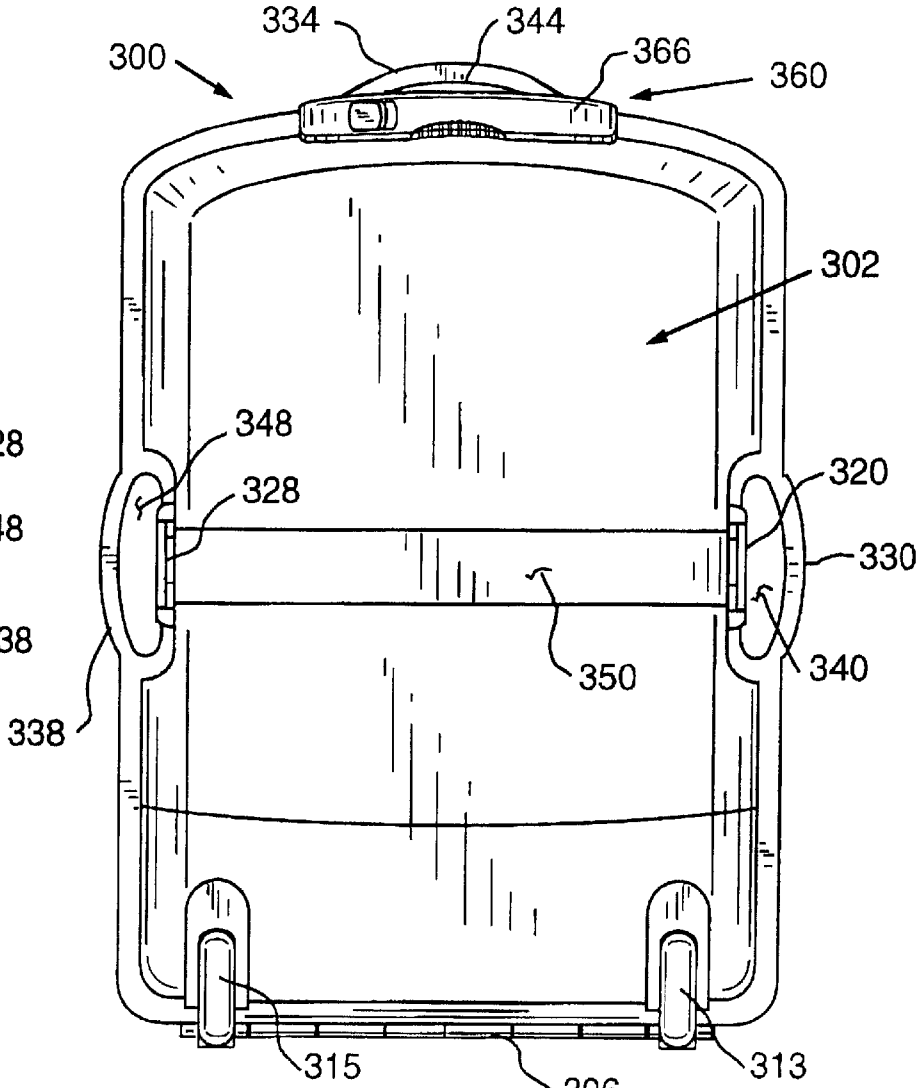
FIG. 10 is a back elevational view of the luggage article of FIG. 5.
Figure 9:
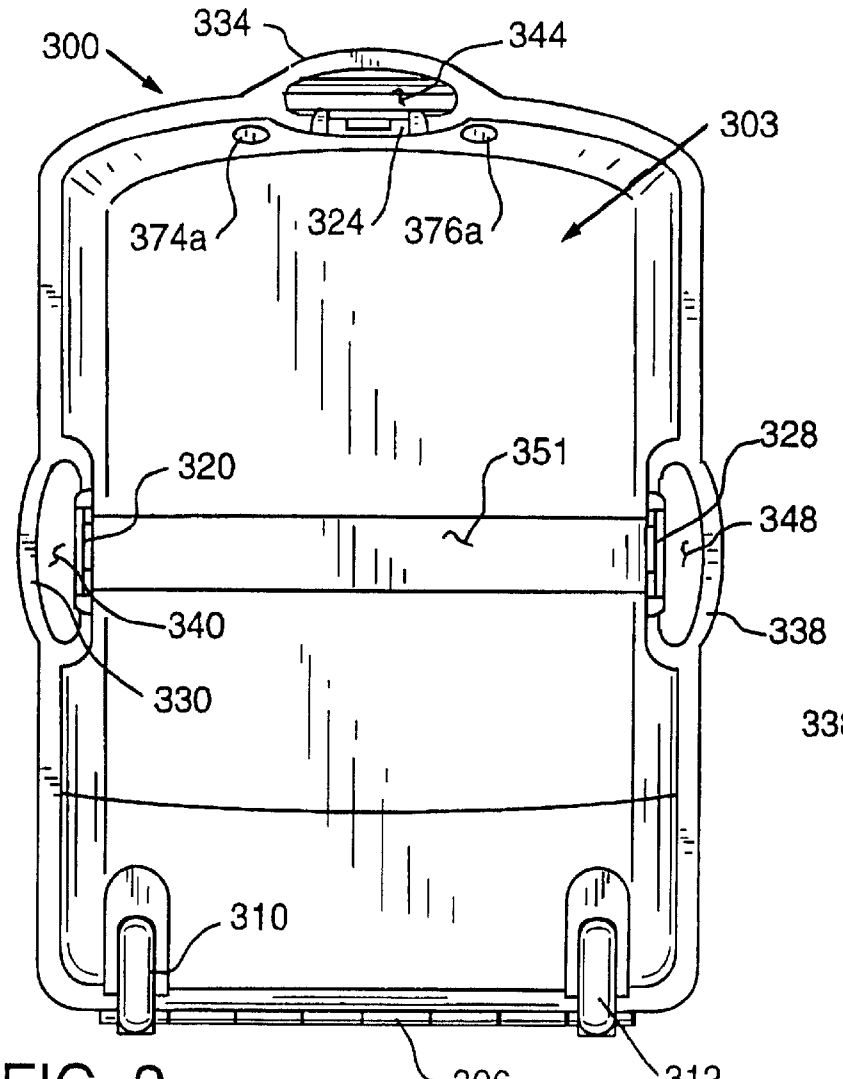
FIG. 9 is a front elevational view of the luggage article of FIG. 5.
Figure 11:
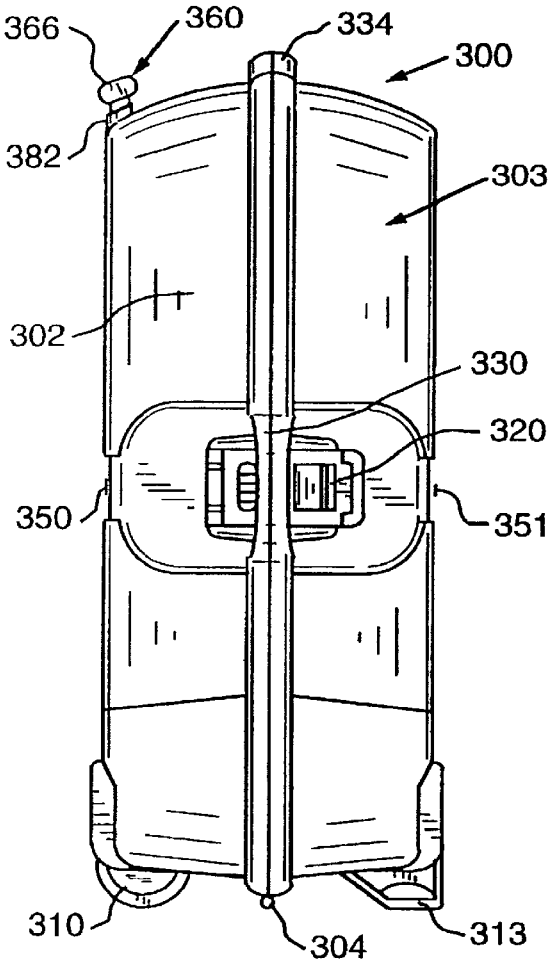
FIG. 11 is a left side elevational view of the luggage article of FIG. 5.
Figure 12:
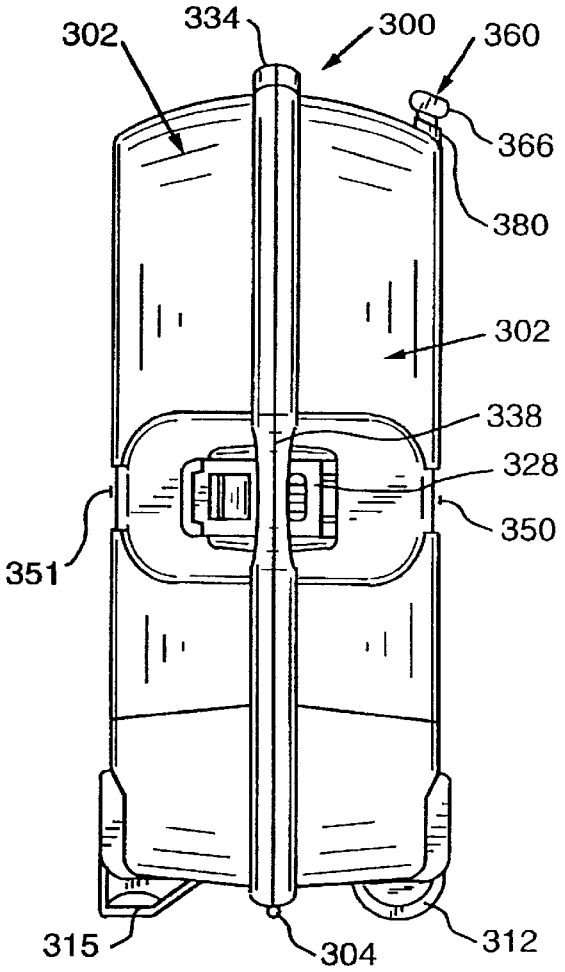
FIG. 12 is a right side elevational view of the luggage article of FIG. 5.

Three safety latches 320, 324 (FIG. 5) and 328 (FIG. 6) are also provided. These safety latches are unique in their own right and will be further discussed below. It will be noted, however, as was mentioned above with respect to FIGS. 1–4, that carrying handle/bumper members 330, 334 and 338, which are formed similarly to carrying handle/bumper members 130, 134 and 138 are provided. As can be seen in FIGS. 5 and 6, the carrying handle/bumper members 330, 334 and 338 provide pockets 340, 344 and 348, respectively, which are large enough to accept an average human hand and the latches 320, 324 and 328. The carrying handle/bumper members 330, 334 and 338 serve as a flying buttress or protective member to protect the latches 320, 324 and 328 and its more delicate components (i.e., locks, tumblers) from harm in case of impacts that luggage articles are normally subjected to.

Another feature of the shells 302, 303 that differs from shells 102, 103 is the provision of a recess 350 (FIG. 10) in shell 302 and recess 351 (FIG. 5) in shell 303. These recesses can accommodate a luggage belt (not shown) that can be used to further secure the two shells 302, 303 to each other.

With a wheeled luggage article, such as luggage article 300, a telescoping handle 360 is provided. As is known, the telescoping handle 360 can be moved from a retracted position (FIG. 5) to an extended position (FIG. 13) in order to facilitate easy wheeling of the luggage article 300. These telescoping handles are well known and consist of a pair of female tubular members mounted in the interior of the luggage article (not shown) which receive a pair of male tubular members 362, 364 (FIG. 13) which are joined together by a gripping member 366. A telescoping handle of basically similar design is shown in commonly owned International Application No. PCT/US99/03368, the disclosure of which is hereby incorporated by reference.

In order to accommodate the telescoping handle 360, a pair of holes 370, 372 must be formed in shell 302. Since the shells are identical, a pair of holes 374, 376 are also formed in shell 303. Holes 374, 376 can be filled with a plug 374*a*, 376*a* (FIG. 5) or, if desired, the molding operation can be slightly modified so that only every other shell is made with the holes 370, 372. As can best be seen in FIG. 13, the holes 370 and 372 receive bushings 380 and 382. Bushing 380 is a conventional bushing, however, bushing 382 is part of the unique locking system for the telescoping handle of the invention, which will be explained below in further detail.

Before discussing the telescoping handle 360 in detail in FIGS. 14–17, it will be appreciated that this invention can be used for any telescoping handle on any type of article and more particularly, any luggage article, and is not limited to use with the substantially identical shells of the invention focussed on herein.

Figure 13:
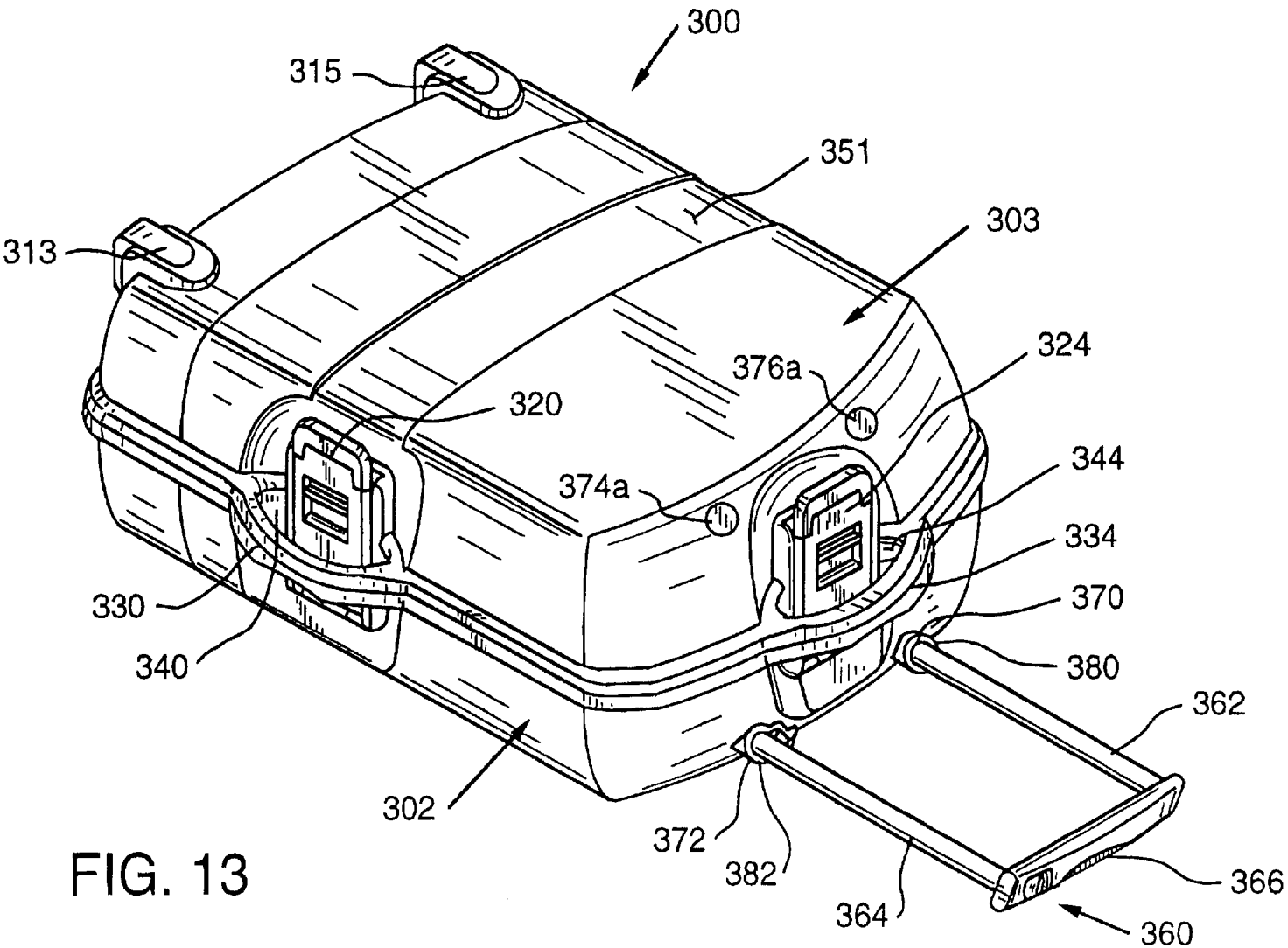
FIG. 13 is a perspective view, similar to FIG. 5, only showing the telescoping handle in an extended position.
Figure 14:
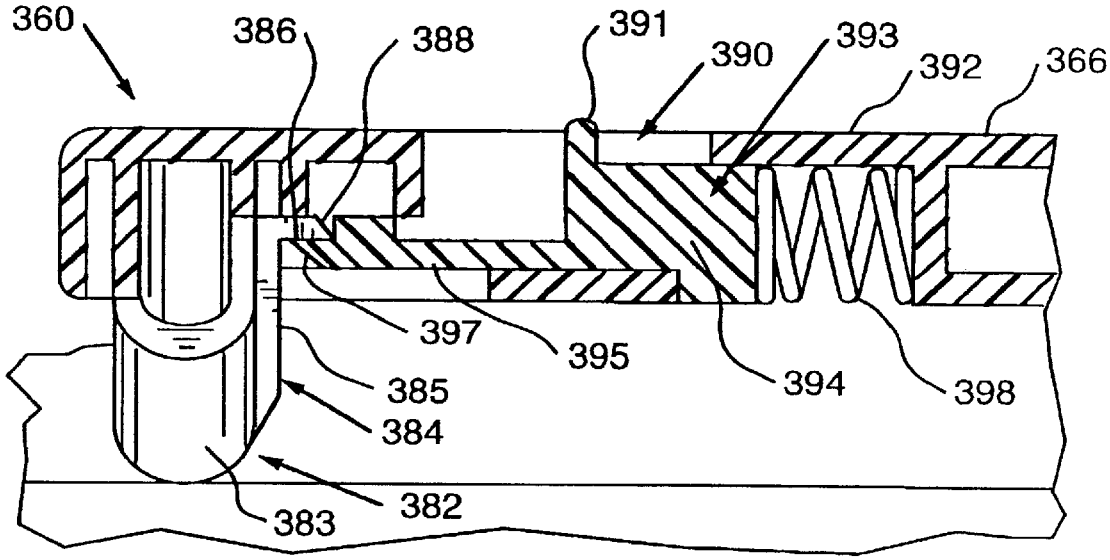
FIG. 14 is an elevational view, partially in cross-section showing the flange of the movable button engaging the flange of the locking hook when the handle assembly is in a retracted position.

FIGS. 14–17 will now be discussed in detail, with reference generally to FIGS. 5 and 13. FIG. 14 shows the telescoping handle 360 in a retracted position (FIG. 5). As discussed above, in accordance with the invention, a unique, integrally molded bushing 382 is provided which is received in hole 372 of shell 302. As can best be seen in FIG. 16, the bushing 382 includes a lower cylindrical portion 383 and a locking hook 384 disposed interiorly thereof. The locking hook 384 includes a longitudinal portion 385 and a flange portion 386. The flange portion 386 includes a free edge 387 which has a sloping, pilot surface 388.

The gripping handle 366, which is shown in cross-section in FIGS. 14–17 for ease of explanation, includes a spring biased movable button 390 mounted therein. The movable button 390 includes (i) an engagement tab 391, which preferably extends above the top surface 392 of the gripping handle 366 for ease in manipulation thereof and (ii) a body portion 393. The body portion 393 includes a main section 394 and a flange portion 395 extending therefrom. Flange portion 395 includes a free edge 396 having a sloping pilot surface 397 which is complementary to sloping pilot surface 388 of flange portion 386 of the locking hook 384. The movable button 390 is spring biased by spring 398 in the position shown in FIG. 14.

As shown in FIG. 14, when the telescoping handle 360 is in a retracted position (FIG. 5), the design of the external locking means of the invention provides a secure locked state for the gripping handle 366 and thus the entire telescoping handle 360. As can be seen, a section of the flange portion 395 of the movable button 390 is disposed in an undercut space 399 beneath the flange portion 386 of the locking hook 384. This will prevent inadvertent movement of the telescoping handle 360.

Figure 15:
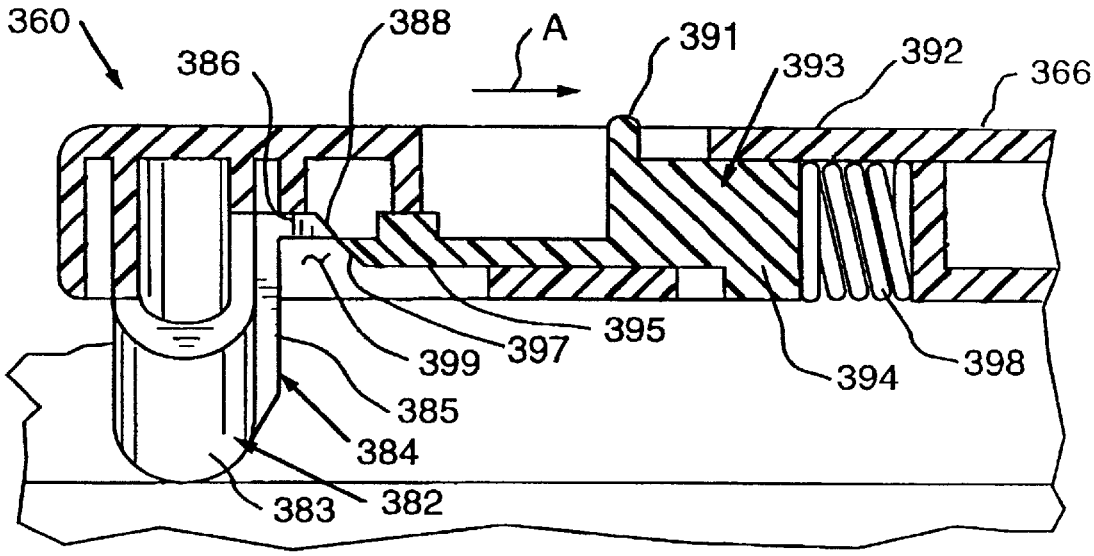
FIG. 15 is a view similar to FIG. 13 only showing the button being moved to disengage from the flange of the locking hook.
Figure 16:
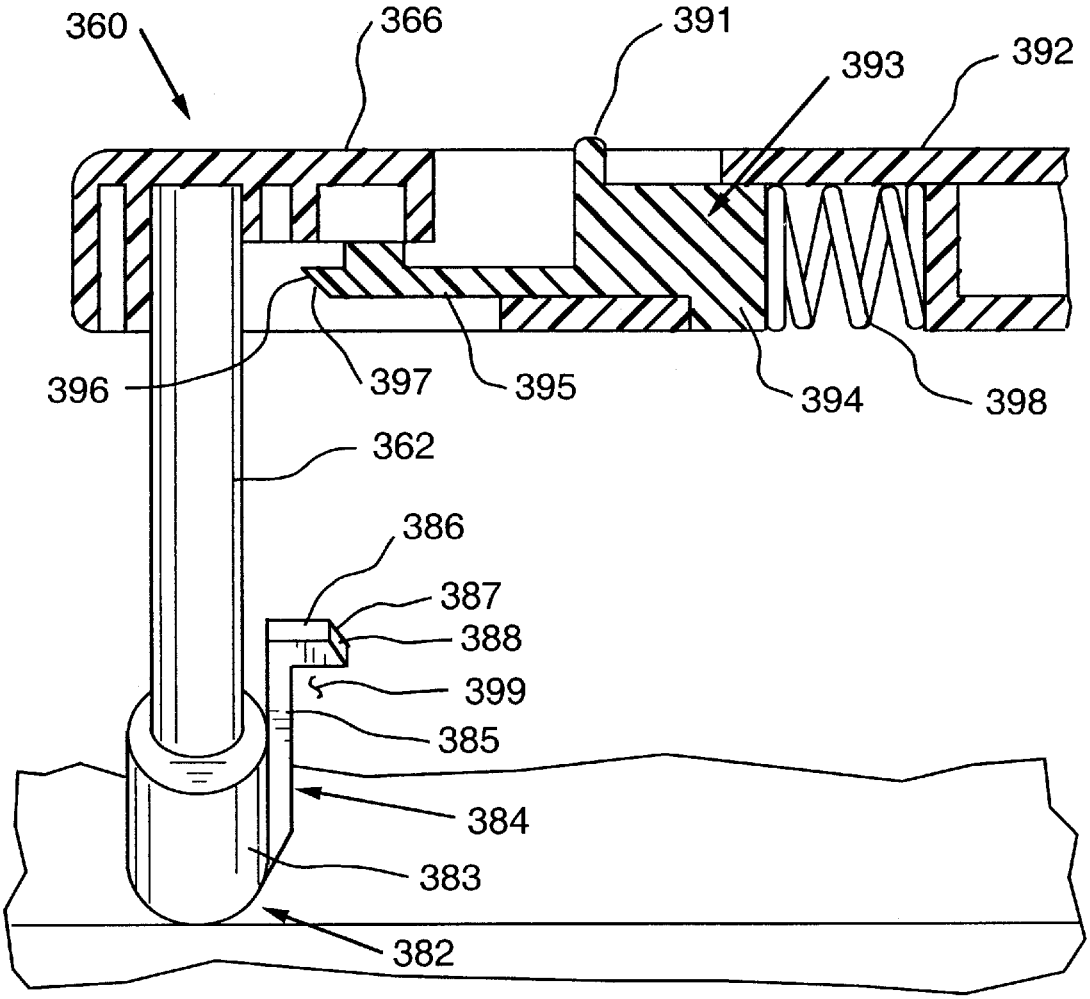
FIG. 16 is a view similar to FIG. 13 only showing the handle assembly in an extended position.

When it is desired to move the telescoping handle 360 from a retracted position (FIGS. 5 and 14) to an extended position (FIGS. 13 and 16), the movable button 390 is moved by a user engaging the engagement tab 391 and moving the button translationally in the direction of Arrow A of FIG. 15, against the bias of spring 398, until flange portion 395 clears away from flange portion 386 of locking hook 384 as is shown in FIG. 15. Once this occurs, the user merely pulls upwardly on the gripping handle 366 to extend the telescoping handle 360 to an extended position as shown in FIG. 16. As can be seen in FIG. 16, once the flanges are clear from one another, the movable button 390 can be released by the user, and the movable button 390 will return to the position similar to that shown in FIG. 14.

Figure 17:
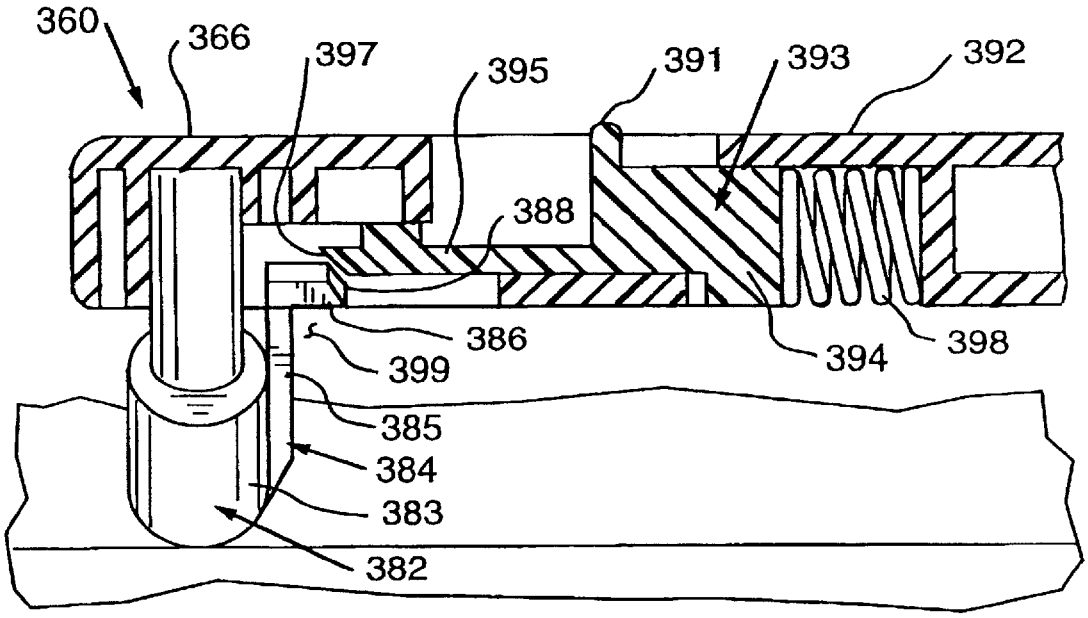
FIG. 17 is a view similar to FIG. 13 only showing the handle assembly being moved from the extended position to the retracted position.

When it is desired to return the telescoping handle 360 from the extended position (FIGS. 13 and 16) to the retracted position (FIGS. 5 and 14), the user merely presses down on the gripping handle 366, causing the male tubes 362 and 364 to go into the female tubes in order to retract the telescoping handle 360. In accordance with the invention, the pilot surface 397 of the flange portion 395 of the movable button 390 will automatically slide past the pilot surface 388 of the flange member 386 of the locking hook 384, as can be seen in FIG. 17. There is no need for the user to move the movable button 390 manually once the flange member 386 of the movable button 390 slides past flange member 386 of the locking hook 384. This provides a secure locking action without the need for the user to manually operate a locking means. Also, there will be a distinctly felt and audible "click" when the movable button 390, because of spring 398, moves into the position of FIG. 14 which will thus indicate to the user that the handle is in a locked position.

Figure 18:
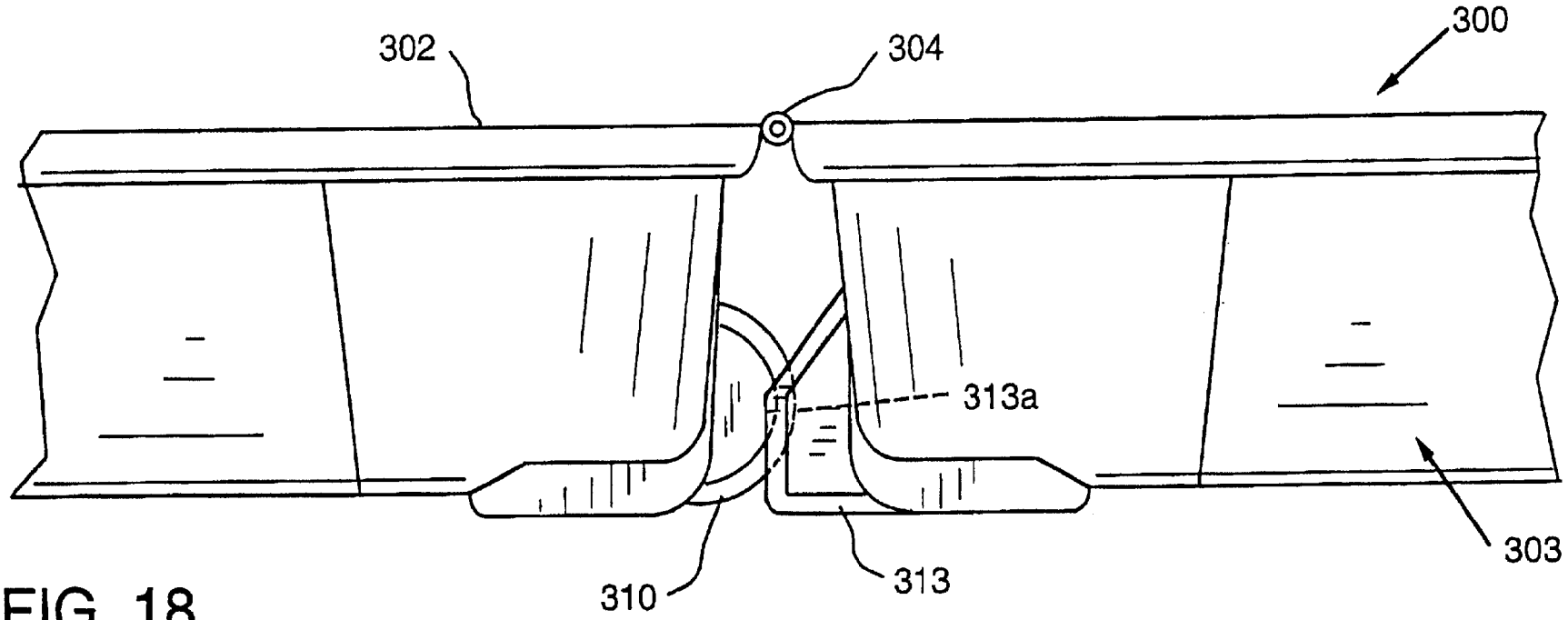
FIG. 18 is an elevational view showing the shells being opened 180°.

Referring now to FIG. 18, another feature of the invention will be shown. In the embodiment of FIGS. 5–13, when it is desired to open the luggage article 300 to a 180° open position, as shown in FIG. 18, each of the resting feet 313, 315 include a recessed portion, such as recessed portion 313*a* shown in resting foot 313. This will allow the wheel 310 to be received therein, which will in turn allow the luggage article 300 to be opened 180° as shown in FIG. 18. If instead of two resting feet and two wheels, four castors are used, the castors will be offset in order to avoid castor-to-castor interference when the shells are desired to be opened 180° or more.

Referring now to FIGS. 19–26, the novel and unique safety latch of the invention will be discussed. The use of this safety latch is not limited to luggage articles, but can be used in any containment article (e.g., toolboxes, lunch boxes, musical instrument cases) that needs a latch. The design of the safety latch is especially suited for use with containment articles having a pair of identical shells (such as containment article 100) as will be discussed with respect to FIG. 22, however, again, the use of the safety latch is not limited to containment articles having identical shells, but can be for other containment articles that have non-identical shells.

Figure 19:
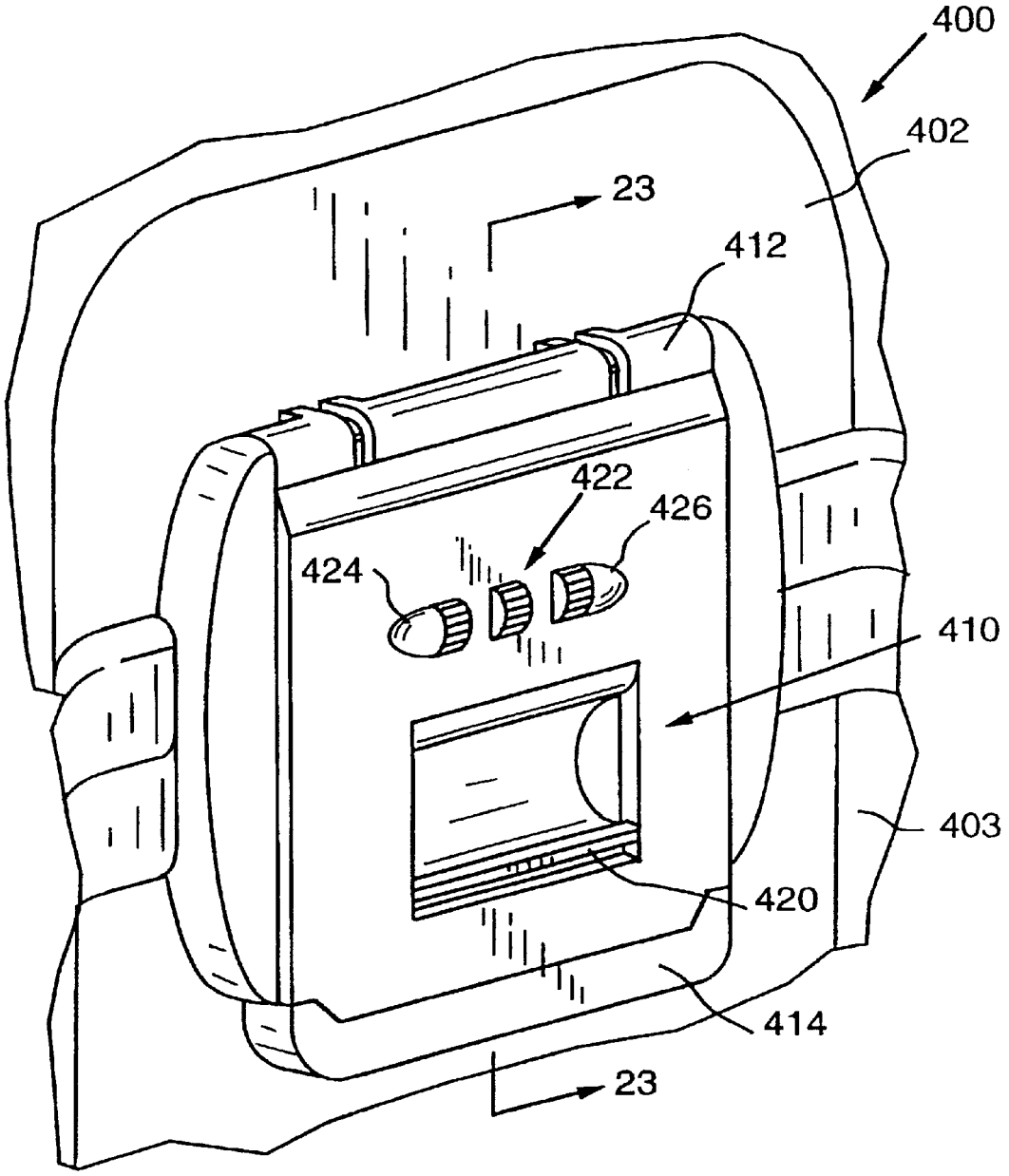
FIG. 19 is a perspective view showing the improved safety latch of the invention in the closed and locked position.
Figure 20:
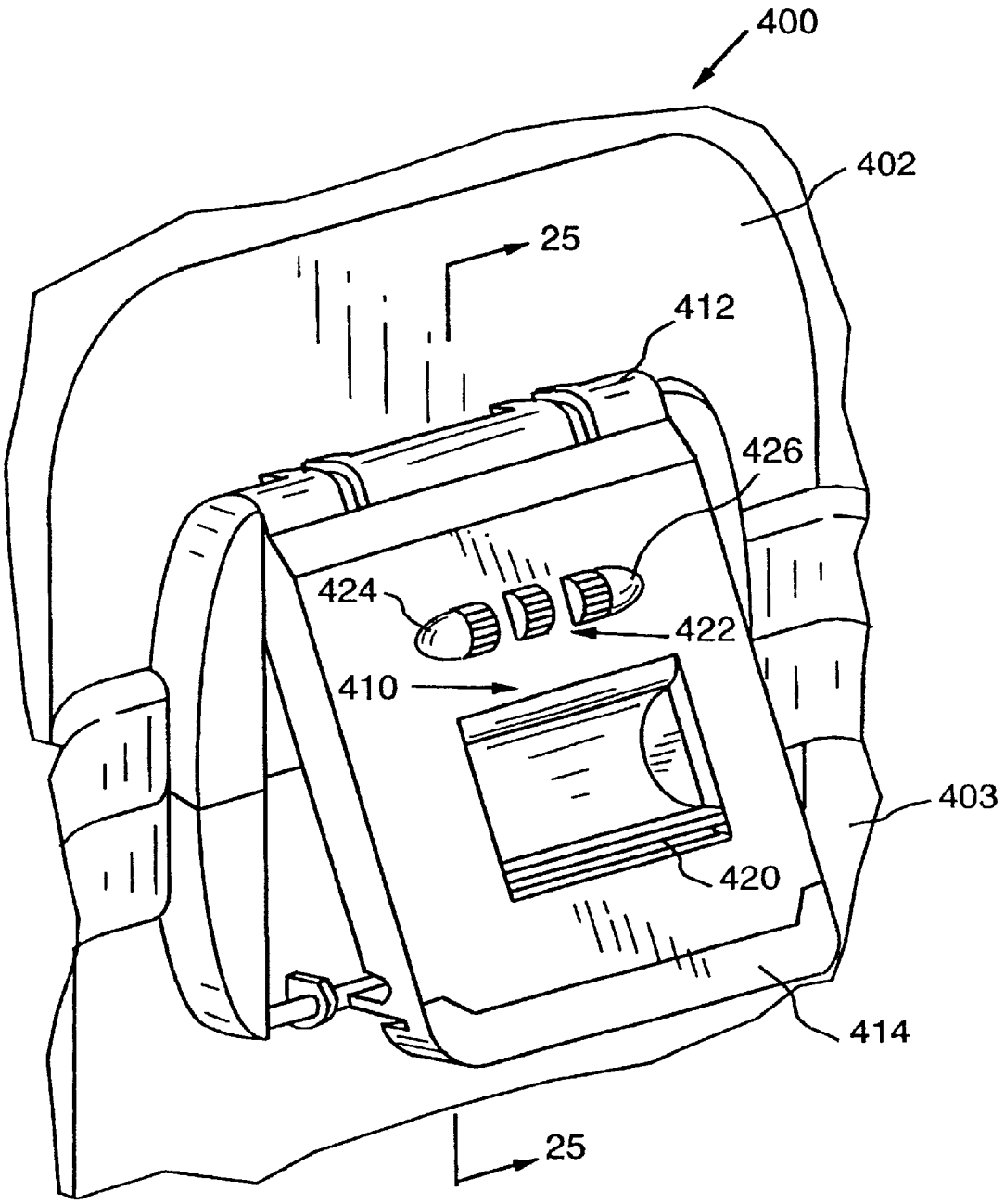
FIG. 20 is a view similar to FIG. 19 only showing the improved safety latch of the invention in an open position.

FIG. 19 shows a portion of a containment article 400 having, in the embodiment, two identical shells 402, 403. The two shells 402, 403 are joined together by a latch 410 made in accordance with the invention. The latch 410 includes (i) a first end 412 which is pivotably mounted to shell 402 and (ii) a second end 414 which is adapted to engage a portion of the second shell 403. Second end 414 can contain an overmolded rubber grip area as is shown in FIGS. 19 and 20. The latch 410 is shown in a closed position in FIG. 19 and is shown in an open position in FIG. 20, wherein the second end 414 is pivoted away from the second shell 403. In the open position (FIG. 20) the two shells 402, 403 can be separated from each other in order to gain access to the interior of the containment article 400.

The second end 414 includes a movable, spring biased tab 420. In accordance with the invention, the movable tab 420 is moved when it is desired to release the latch 410 into an open position. When it is desired to lock the latch 410, the latch 410 is pivoted back towards the second shell 403 and is merely pushed thereon and automatically locks in place without the need to manually engage the movable tab 420. In this way, the latch 410 is always automatically locked when it is in the closed position.

The safety latch 410 can also be provided, optionally, with a locking means, such as tumbler 422 having three tumbler wheels, in order to lock the movable tab 420 in a closed position. Optionally and preferably, protrusions 424 and 426 are provided to protect the sides of the outer tumbler wheels.

Figure 21:
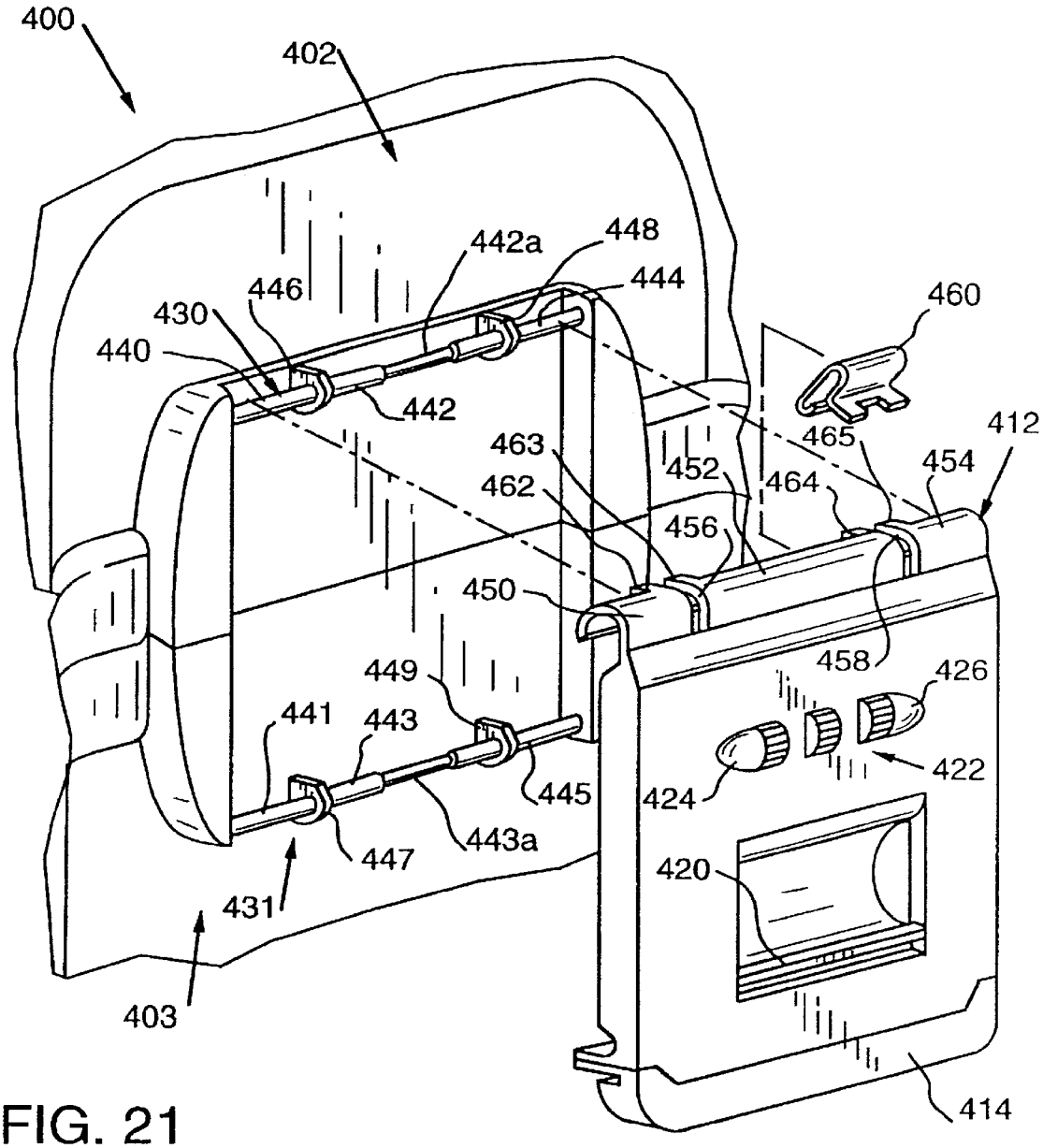
FIG. 21 is an exploded perspective view of the safety latch.

Referring now to FIG. 21, the connection between the containment article 400 and the safety latch 410 will be discussed. This containment article 400 is similar to those discussed above, in that the shells 402 and 403 are substantially identical. Thus, each shell 402, 403 includes spaced, identical rods 430, 431 which are the connection points for the safety latch 410. It will be appreciated that the safety latch 410 is designed specifically to accommodate identical shells, although, as was discussed above, the invention of the safety latch 410 is not limited to use on containment articles having identical shells. As can be seen in FIG. 21, preferably each rod 430, 431 includes three sections 440, 441; 442, 443; and 444, 445. Central rod sections 442, 443 each include a reduced diameter portion 442*a*, 443*a*. The three sections are divided by two webs 446, 447 and 448, 449. The webs divide the rods 430, 431 into smaller more rigid sections so as to increase the strength of the rods 430, 431. The first end 412 of the latch 410 is permanently, but pivotably, attached to rod 430. It will be noted that first end 412 of the latch 410 includes three curved sections 450, 452, 454 with spaces 456 and 458 therebetween. As can be seen in FIG. 21, the curved sections 450, 452 and 454 are attached to rod sections 440, 442 and 444, with webs 446 and 448 being received in spaces 456 and 458. Apart from providing added strength, the two outer curved sections 450 and 454 protect the tab portion of the slider (explained below in more detail) and also resist against opening forces or an accidental blow. Optionally, and preferably, a leaf spring 460 is received in reduced diameter portion 442*a*. This spring 460 will cause the latch to "pop open" when released and will also help prevent the latch 410 from being opened too far, which is an advantage when using the latch 410 on containment articles having the bumper members (see FIG. 1). Further limiting the opening angle are stops 462, 463, 464 and 465. The function of the stops will be explained more fully with respect to FIG. 25. Limiting the opening angle is important in order to resist the latch 410 from contacting the bumper member, thus resisting damage and fouling of the latch body, tumbler and movable tab.

Figure 22:
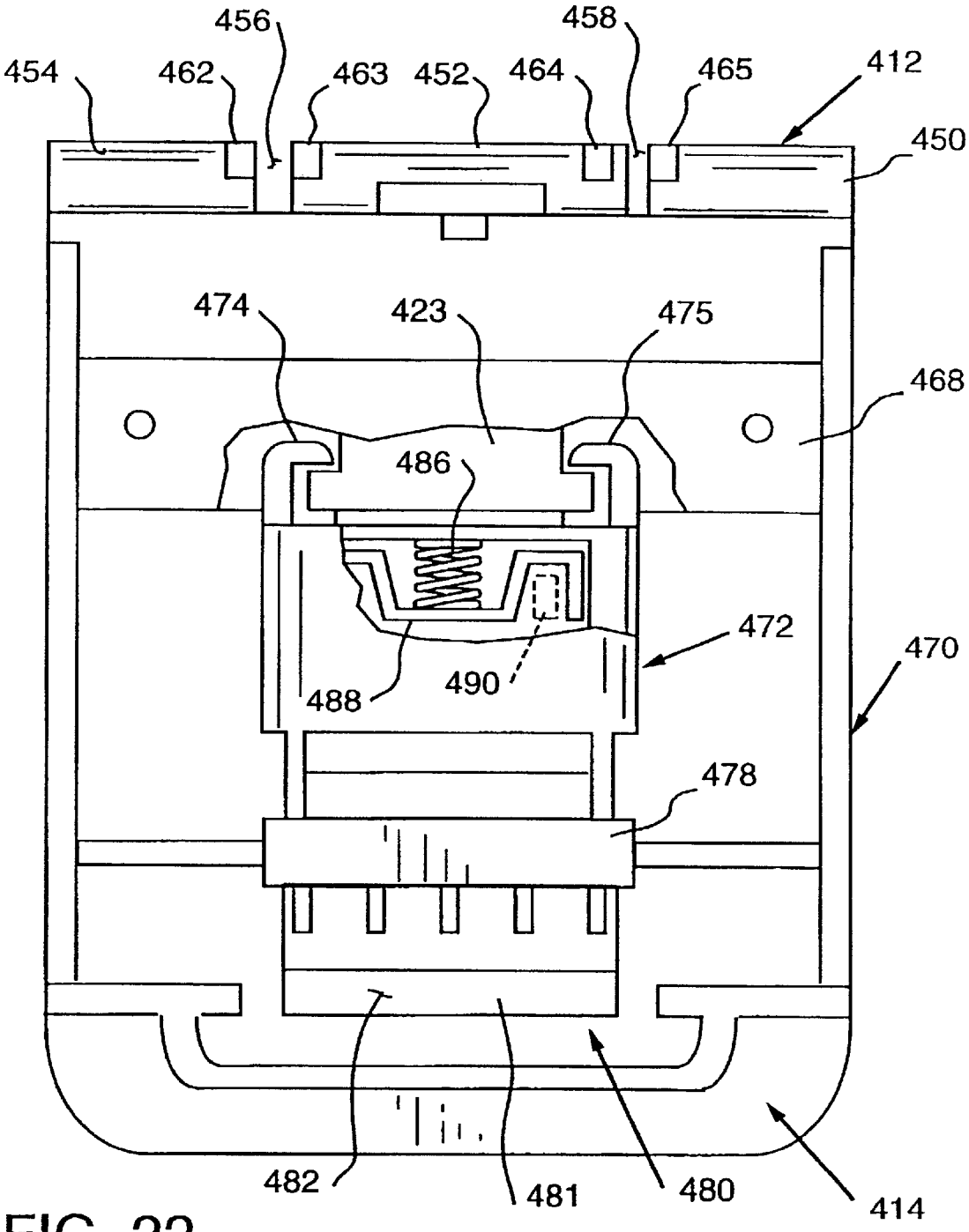
FIG. 22 is a back view, partially cutaway, of the latch.
Figure 23:
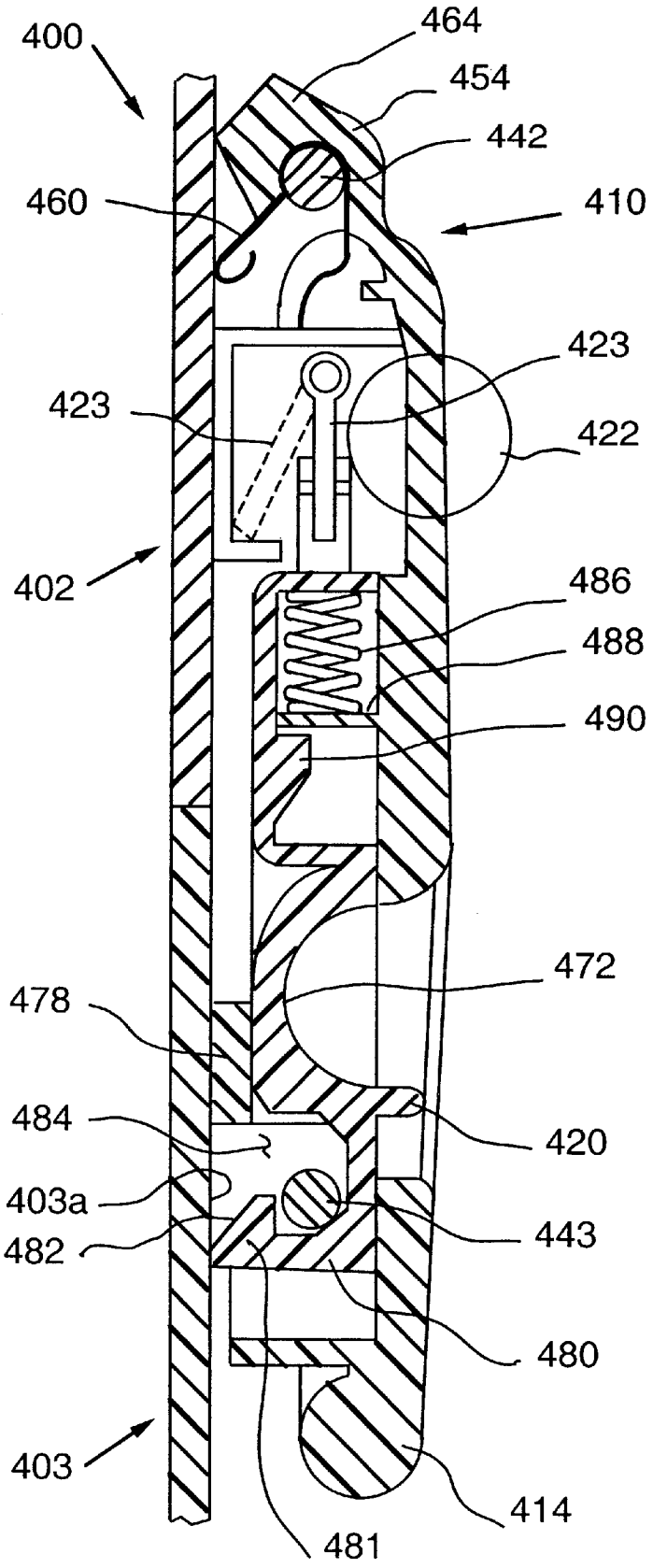
FIG. 23 is a cross-sectional view taken along line 23—23 of FIG. 19.

Referring now to FIGS. 22 and 23, the latch 410 will be described in more detail. The latch 410 includes a latch body 470, the tumbler housing 468 (which contains the tumbler 422) and a slider member 472 of which the movable tab 420 (FIG. 19) is a part. The slider member 472 includes a pair of opposed hooks 474, 475 which are received into the tumbler housing 468, and which, as is known, provides the mechanism for locking the slider member 472 in a closed position. As can be seen in these figures, the gate 423 of the tumbler moves from a locked position (the solid line in FIG. 23) to the unlocked position (phantom line in FIG. 23). The slider member 472 is held in place by a cross-member 478 which is integrally formed with the latch body 470. The slider member 472 includes a rod engagement portion 480, having a flange 481 that terminates in a sloping pilot surface 482. As can be seen in FIG. 23, the flange 481 is received in an undercut space 484 formed between the central bar section 443 and the outside surface 403*a* of shell 403. It will be appreciated that the latch 410 is in the closed position as shown in FIG. 23.

The slider member 472 contains one central spring 486 housed therein. The spring 486 has one end attached to the body of the slider and a second end which is attached to a standing wall 488 which is attached to the latch body 470. In this way, the spring 486 biases the slider member 472 into the position shown in FIG. 23. An alternative to the separate spring 486, an integrally molded plastic spring, which is part of the slider member 472, can be provided. This will eliminate a separate piece and simplify the number of parts needed. A slider stop means 490 is provided to prevent the slider member 472 from escaping from the latch body 470. It will be noted from FIG. 23, that the leaf spring 460 is under compression when the latch 410 is in the closed position of FIG. 23.

Figure 24:
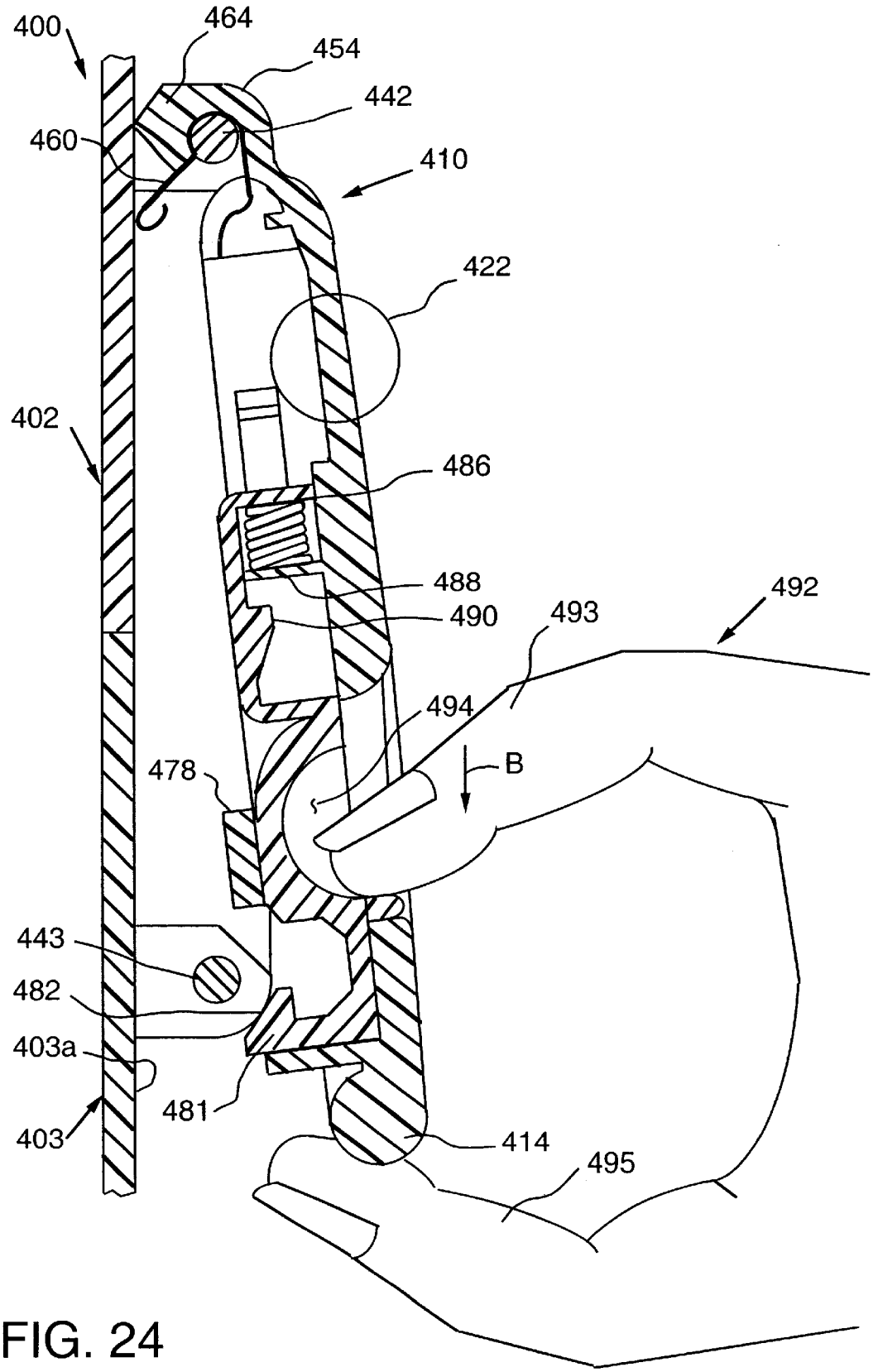
FIG. 24 is a view similar to FIG. 23, only showing the latch being moved to an open position.
Figure 25:
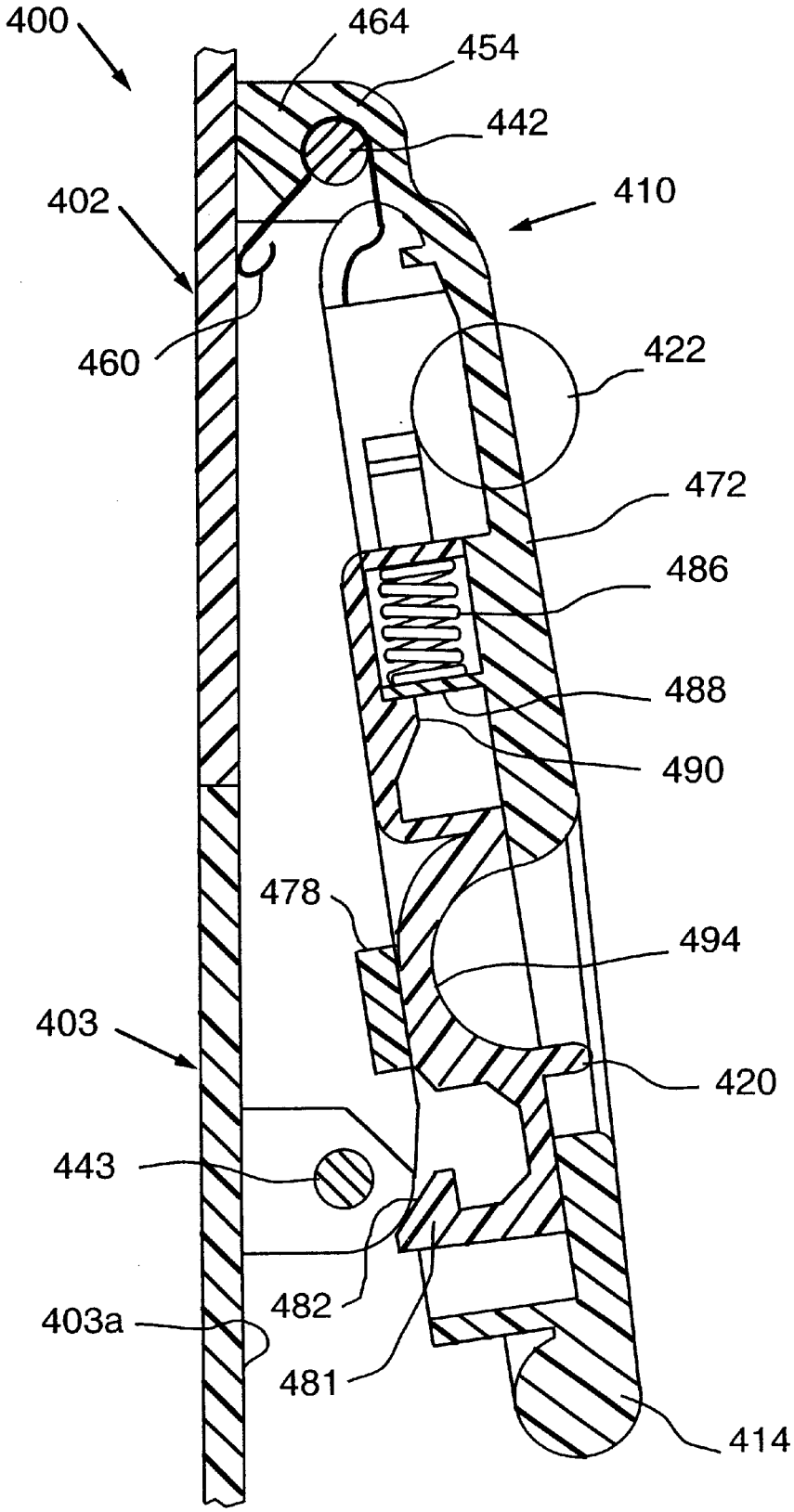
FIG. 25 is a cross-sectional view taken along line 25—25 of FIG. 20.

Referring now to FIG. 24, when it is desired to move the latch 410 from the closed position (FIGS. 19 and 23) to the open position (FIG. 20), the user 492 merely places his or her index finger 493 into the scooped out area 494 of the slider member 472 and places his or her thumb 495 on the second end 414 of the latch 410 and with a squeezing action, moves the movable tab 420 and thus the entire slider member 472 downwardly in the direction of Arrow B. As can be seen in FIG. 24, the spring 486 compresses against the standing wall 488. This will allow the flange 481 to clear the central bar section 443, and once it does, the force of leaf spring 460 will cause the latch to "pop open" into the open position shown in FIGS. 20 and 25. It will be appreciated by observing FIG. 25 that the mechanical stops 462, 463, 464 and 465 (stop 464 shown in FIG. 25) will limit the opening angle. It will be further appreciated that the slider member 472 will return to the position of FIG. 23 when the latch 410 is opened, due to the spring 486 again being expanded and the stop member 490 limiting the movement of the slider member 472.

Figure 26:
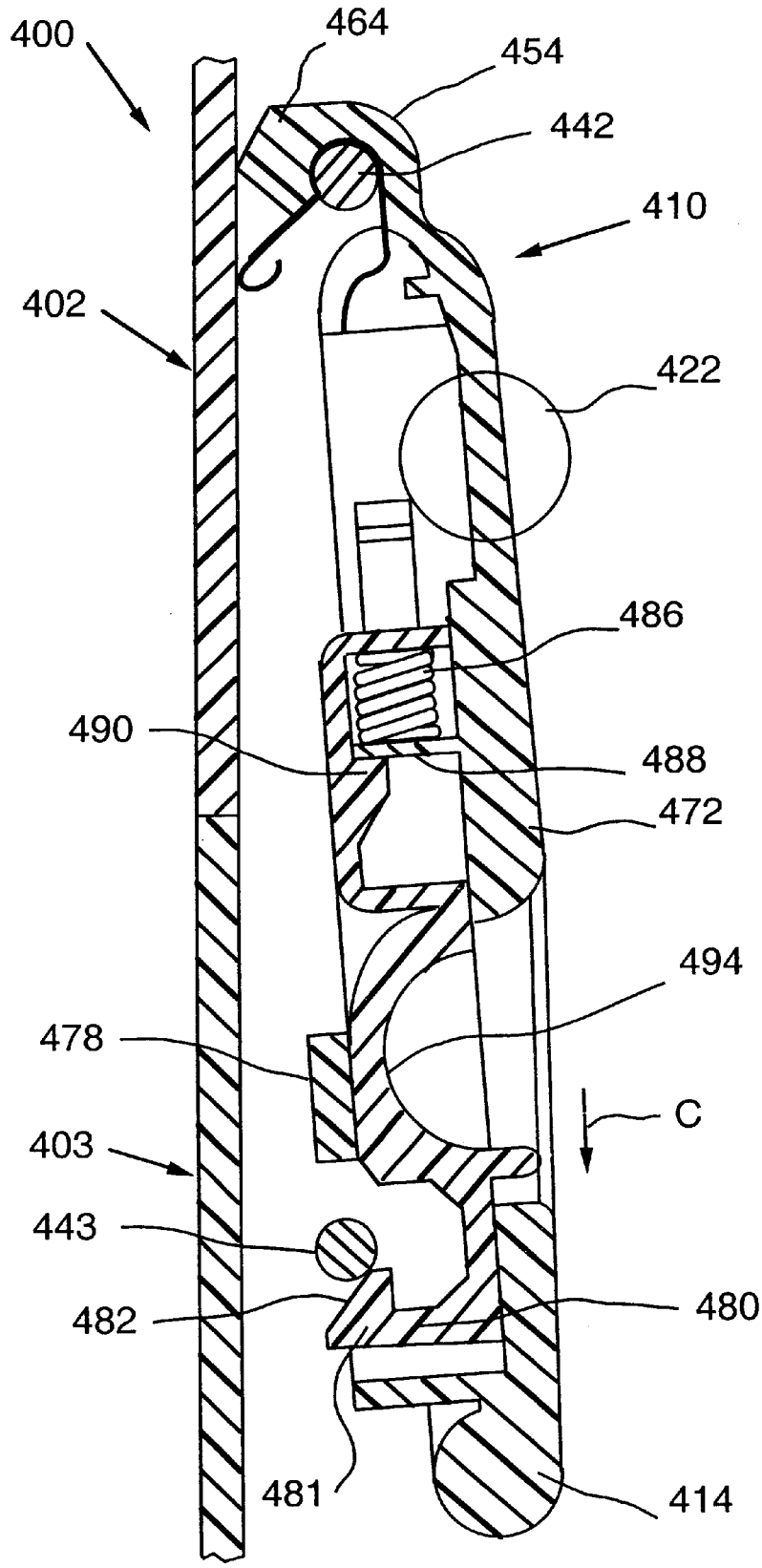
FIG. 26 is a view similar to FIG. 23, only showing the latch being moved from an open position to a closed position.

Referring to FIG. 26, when it is desired to return the latch 410 from an open position to a closed position, the user merely pushes inwardly against second end 414 and, because of the sloped pilot surface 482 of the flange 481, the flange 481 will ride over the central bar section 443, thus causing the slider member to move downwardly (in the direction of Arrow C) automatically (that is without the user having to manually engage the movable tab 420). A distinctly felt and audibly noticeable "click" will indicate to the user that the safety latch 410 is in a closed position. The user then has the option of locking the slider member 472 in the closed position by using the tumbler 422.

It will be appreciated that a unique and novel containment article has been provided. The containment article has substantially identical shells which are hingedly connected to each other. One specific type of containment article that provided is a luggage article. The luggage article also includes a unique and novel telescoping handle assembly. Finally, an improved safety latch for a containment article, such as a luggage article, is also provided.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breath of the appended claims and any all equivalents thereof.

What is claimed is:

1. A luggage article comprising:

a pair of substantially identical plastic shells which are hingedly connected to each other, in which said shells each include a perimeter;

a tongue extending from a portion of said perimeter; and a groove defined in another portion of said perimeter, whereby when said shells are joined to form said luggage article, said tongue of a first of said shells engages into said groove of a second of said shells and said tongue of said second shell engages into said groove of said first shell.

2. The luggage article of claim 1, wherein said first shell includes a plurality of spaced apart hinge tubes each defining a hinge pin opening and said second shell includes a plurality of spaced apart hinge tubes each defining a hinge pin opening such that when said first shell and said second shell are joined to form said luggage article, said hinge pin openings of said hinge tubes of said first shell generally align with said hinge pin openings of said hinge tubes of said second shell; and a hinge pin inserted through said aligned hinge pin openings.

3. The luggage article of claim 1, wherein said plastic material is selected from the group consisting of polypropylene, polyethylene, polystyrene, polycarbonate, polyvinyl chloride and acrylonitrile-butadiene-styrene resin.

4. The luggage article of claim 1, including at least one latch for securing said pair of shells together in order to close said luggage article.

5. The luggage article of claim 4, wherein said shells are constructed and arranged so as to form a bumper to protect said latch.

6. The luggage article of claim 5, wherein said bumper includes a integrally formed member extending from a first of said pair of shells and a complementary integrally formed member extending from a second of said pair of shells, said members and said shells forming a pocket in which said latch is disposed.

7. The luggage article of claim 4, wherein said latch has (i) a first end which is pivotably mounted to a first of said shells and (ii) a second end which is adapted to engage a portion of a second of said shells so that said latch can move from a closed position to an open position.

8. The luggage article of claim 7, wherein said second end includes a movable tab which engages said portion of said second shell in order to latch said first shell to said second shell when said latch is in said closed position; and said portion of said second shell including a rod that is spaced from a surface of said second shell.

9. The luggage article of claim 8, wherein said movable tab includes an external engagement portion and an internal flange having a pilot surface, whereby when said latch is desired to be moved from said closed position to said open position, said external engagement portion is moved thus allowing said internal flange to be moved clear from said rod and whereby when said latch is desired to be moved from said open position to said closed position, said pilot surface engages against said rod in such a way that said rod automatically causes said tab to move to allow said internal flange to be received in an undercut space defined by said rod and said second shell.

10. The luggage article of claim 9, wherein said tab is biased in a rod engaging position by means of a spring so that when it is desired to move said latch from said closed position to said open position, said spring is compressed by movement of said tab such that said internal flange can be moved clear of said rod.

11. The luggage article of claim 7, including a leaf spring interposed between said first shell and said first end of said latch, whereby said latch is adapted to pop open when released.

12. The luggage article of claim 11, including mechanical stop means disposed on said first end to limit the angle opening of said latch.

13. The luggage article of claim 7, including a locking device for locking said movable tab in a closed position.

14. The luggage article of claim 1, wherein each of said shells includes at least one cavity, said cavity adapted to receive a device selected from the group consisting of a wheel, a foot member, and a castor.

15. A luggage article comprising:

a pair of substantially identical plastic shells which are hingedly connected to each other;

at least one latch for securing said pair of shells together in order to close said luggage article;

said shells being constructed and arranged so as to form a bumper to protect said latch;

said bumper including an integrally formed member extending from a first of said pair of shells and a complementary integrally formed member extending from a second of said pair of shells, said members and said shells forming a pocket in which said latch is disposed; and a luggage belt recess formed in each of said pair of shells, said recess being positioned such that a luggage belt can engage into said recess and over top of said bumper.

16. A luggage article comprising:

a pair of substantially identical plastic shells which are hingedly connected to each other;

at least one latch for securing said pair of shells together in order to close said luggage article;

said latch has (i) a first end which is pivotably mounted to a first of said shells and (ii) a second end which is adapted to engage a portion of a second of said shells so that said latch can move from a closed position to an open position; and said first shell includes a rod and said second shell includes an identical rod, said first end of said latch being pivotably mounted to said rod of said first shell and said second end of said latch being adapted to engage said rod of said second shell.

17. The luggage article of claim 16, wherein said rod includes a pair of opposed outer portions and a central portion, said internal flange engaging said central portion.

18. A luggage article comprising:

a pair of substantially identical plastic shells which are hingedly connected to each other;

a first of said pair of shells includes a cavity that receives a wheel assembly and a second of said pair of shells includes a substantially identical cavity that receives a foot member; and said foot member includes a cut-out area for receiving a portion of said wheel when one of said shells is rotated to an open position.

19. The luggage article of claim 18, wherein said foot member includes stop means for controlling the extent of rotation of one of said shells with respect to the other.

20. The luggage article of claim 18, including a telescoping handle assembly having a pair of female tubes mounted on the inside of one of said shells, a pair of slidable male tubes received in said female tubes and a gripping member attached to one end of each of said slidable male tubes.

21. The luggage article of claim 20, including external locking means for said telescoping handle assembly, said external locking means comprising:

a movable button operatively associated with said gripping member; and a locking hook mounted on an outside surface of said luggage article, whereby selective engagement of said movable button can enable movement of said telescoping handle assembly back and forth between a retracted position and an extended position.

22. The luggage article of claim 21, wherein said locking hook includes a flange having an upper pilot surface and said movable button includes a flange having a lower pilot surface that is complementary to said upper pilot surface of said locking hook;

said movable button is spring biased into an engaging position and is movable manually against said spring bias to a disengaging position when it is desired to move said handle from said retracted position to said extended position; and when it is desired to move said handle from said extended position to said retracted position, said flange of said movable button can slide past said flange of said locking hook without the need to manually engage said movable button due to the construction and arrangement of said lower pilot surface of said movable button and said upper pilot surface of said locking hook.

23. The luggage article of claim 22, wherein said locking hook is integrally formed with a bushing that receives one of said slidable male tubes.

24. A telescoping handle assembly for a luggage article, said handle assembly having a pair of female tubes mounted on the inside of said luggage article, a pair of slidable male tubes received in said female tubes, and a gripping member attached to one end of each of said slidable male tubes, the improvement comprising an external locking means including (i) a movable button operatively associated with said gripping member and (ii) a locking hook mounted on an outside surface of said article, whereby selective engagement of said movable button can enable movement of said telescoping handle assembly back and forth between a retracted position to an extended position;

said locking hook including a flange having an upper pilot surface and said movable button including a flange having a lower pilot surface that is complementary to said upper pilot surface of said locking hook;

said movable button being spring biased into an engaging position and being movable manually against said spring bias to a disengaging position when it is desired to move said handle from said retracted position to said extended position; and when it is desired to move said telescoping handle assembly from said extended position to said retracted position, said flange of said movable button can slide past said flange of said locking hook without the need to manually engage said movable button due to the construction and arrangement of said lower pilot surface of said movable button and said upper pilot surface of said locking hook; and wherein said locking hook is integrally formed with a bushing that receives one of said slidable male tubes.

25. A containment article comprising:

a first shell including a plurality of first hinge tubes;

a second shell including a plurality of second hinge tubes;

the first and second hinge tubes being axially aligned with one another;

the first and second shells being movable with respect to one another about the first and second hinge tubes;

the first shell, including the first hinge tubes, being substantially identical to the second shell, including the second hinge tubes; and a telescoping handle disposed on one of the first and second shells, the telescoping handle including a pair of female tubes mounted on the inside of said containment article, a pair of slidable male tubes received in said female tubes, a gripping member attached to one end of each of said slidable male tubes, and an external locking means including (i) a movable button operatively associated with said gripping member and (ii) a locking hook mounted on an outside surface of said containment article, whereby selective engagement of said movable button can enable movement of said telescoping handle assembly back and forth between a retracted position to an extended position.

26. The containment article as set forth in claim 25, in which the first and second hinge tubes each are formed with a hinge pin opening, and in which the containment article further comprises a hinge pin received in the hinge pin openings.

27. The containment article as set forth in claim 25, in which the first shell and first hinge tubes are integrally formed with one another as a single monolithic member, and in which the second shell and second hinge tubes are integrally formed with one another as a single monolithic member.

28. The containment article as set forth in claim 25, further comprising at least one latch for securing the first and second shells together in order to close the containment article.

* * * * *

UNITED STATES PATENT AND TRADEMARK OFFICE

CERTIFICATE OF CORRECTION

PATENT NO. : 6,367,603 B1
DATED : April 9, 2002
INVENTOR(S) : Paolo M.B. Tiramani et al.

It is certified that error appears in the above-identified patent and that said Letters Patent is hereby corrected as shown below:

Column 1,
Line 16, delete the "," after "method".

Column 8,
Line 6, insert -- latch -- after "against".

Signed and Sealed this

Nineteenth Day of November, 2002

*Attest:*

*Attesting Officer*

JAMES E. ROGAN
*Director of the United States Patent and Trademark Office*